United States Patent [19]

Harden et al.

[11] 4,206,450

[45] Jun. 3, 1980

[54] FIRE AND INTRUSION SECURITY SYSTEM

[75] Inventors: Phillip L. Harden, Roanoke; William E. Hunkler, Fort Wayne; John L. Schnieders, Markle; John E. Weber, Fort Wayne, all of Ind.

[73] Assignee: Bowmar Instrument Corporation, Fort Wayne, Ind.

[21] Appl. No.: 536,385

[22] Filed: Dec. 26, 1974

[51] Int. Cl.[2] ..... G08B 19/00; G08B 13/00; G08B 29/00; G08B 3/00

[52] U.S. Cl. ..... 340/521; 328/75; 340/309.1; 340/384 E; 340/514; 340/515; 340/528; 340/541

[58] Field of Search ..... 340/420, 274, 214, 237 S, 340/293, 227 R, 276, 223, 249, 213 R, 258 R, 258 B, 63, 64, 65, 54, 541, 514, 515, 516, 577, 584, 542, 523, 636, 524, 552, 528, 384 E

[56] References Cited

U.S. PATENT DOCUMENTS

| | | | |
|---|---|---|---|
| 3,196,357 | 7/1965 | Hoag | 340/249 |
| 3,487,404 | 12/1969 | Midkiff | 340/420 |
| 3,513,466 | 5/1970 | Isaacs et al. | 340/274 |
| 3,540,043 | 11/1970 | Crosthwait | 340/420 |
| 3,544,987 | 12/1970 | McMann et al. | 340/274 R |
| 3,546,688 | 12/1970 | Jensen | 340/214 |
| 3,581,105 | 5/1971 | Gish | 340/258 R |
| 3,585,621 | 6/1971 | DiCello | 340/274 |
| 3,623,087 | 11/1971 | Gallichotte et al. | 340/285 |
| 3,678,511 | 7/1972 | Benedict | 340/420 |
| 3,685,587 | 8/1972 | Pugh et al. | 169/19 |
| 3,686,668 | 8/1972 | Durkee | 340/420 |
| 3,699,569 | 10/1972 | Lee | 340/276 |
| 3,789,384 | 1/1974 | Akers | 340/420 |
| 3,846,782 | 11/1974 | Brodsky | 340/274 |
| 3,879,718 | 4/1975 | Roberts | 340/237 S |
| 3,978,478 | 8/1976 | Schmitz | 340/420 |

*Primary Examiner*—John W. Caldwell, Sr.
*Assistant Examiner*—James J. Groody
*Attorney, Agent, or Firm*—Gust, Irish, Jeffers & Hoffman

[57] ABSTRACT

A security system which includes closed loop fire detection circuitry, having a continuous monitor of the pyrogenic sensors, closed loop intrusion detection circuitry, a multiple tone audible alarm generator, a coded keyboard digital electronic lock circuit, and a fail-safe alternating current, direct current power supply which includes a battery, battery charging circuit, and a system testing facility. The audible alarm circuitry includes a modulated tone frequency generator and a modulating circuit operable between a plurality of states in response to different alarm conditions. The fire and intrusion circuits include filter circuits to prevent spurious operation, and feedback latching circuits for generating continuous alarm signals in response to a breach of the system. The entire circuit is fabricated with solid state electronic components including micro-electronic circuitry. Further, test circuits are provided with visual and audible signals to indicate status of intrusion sensors, pyrogenic sensors, and battery condition. Individual arming circuits for perimeter intrusion and interior intrusion are provided with visual signals for each.

5 Claims, 11 Drawing Figures

800
28
LEVEL DETECTOR
90
92
PYROGENIC LATCH
94
98
96
5
26
A.
140
B.
4
78
74
SECURITY LAMP DRIVER
76
+12VDC
100
6
TIMER CIRCUIT
122
60'
62
66
108
104
114
118
120
LEVEL DETECTOR
INTRUSION SENSOR LATCH
MODULATING CIRCUIT
TONE GEN.
AUDIBLE SIGNAL GEN.
60
64
700
106
110
112
116
71
80
82
EXIT TIMER
ARM LAMP DRIVER
516
72
70
ARM- DISARM LATCH
6
4
424
54
56
52
48
LOCK SEQUENCE LOGIC
TIMER
INSIDE KEYBOARD
3
50
CODING MEANS
46
OUTSIDE KEYBOARD

2
TEST
RESET
NORMAL
TIMER 16
TIMER 32
120 VAC
+12VDC

MAT ARM CIRCUIT
580
FLOOR MAT
DISARM
MAT ARM
ARM
+12VDC
+12VDC
+12VDC
+12VDC
+12VDC
+12VDC
Y.
W.
70

516
690
696
688
686
684
714
668
728
720
710
722
724
726
134
+12VDC
676
674
694
680
692
666
682
138
716
134
+12VDC
718
712
138
678
670
660
654
664
134
658
652
656
662
134
778
776
672
770
788
772
774
780
138
646
648
650
12VDC
134
71
730
744
673
738
740
742
(8)
766
(3)
734
TIMER
746
(2)
(6)
750
748
(7)
(1)
736
265
Y
138
762
764
758
752
66
760
792
Y
700
790
704
642
655
644
754
ALARM
767
732
657
EXIT
134
60'
W
60
138
706
138
N.C. DOOR
AND
WINDOW
SENSORS
+12VDC

FIRE AND INTRUSION SECURITY SYSTEM

BACKGROUND OF THE INVENTION

1. Field of the Invention

The present invention relates to intrusion and pyrogenic security systems and in particular to a security system for use in a home or other premises, the system being entirely electronic and providing for the securement of the premises and generation of alarm signals for all common breaches of security thereof.

2. Description of the Prior Art

The need for a security system to protect a premises such as a home, office, warehouse, factory, or the like, its contents, and inhabitants, has long been recognized. To satisfy this need, security systems that will provide a local or a remote alarm signal in the event of a breach of security of the premises, such as a breach including an unauthorized intrusion, a fire, or the like, have been developed and are commercially available. Some of these systems provide an alarm signal in response to an unauthorized intrusion such as by a burglar, others provide alarms in response to fire and smoke, and some systems generate an alarm signal in response to either or both such conditions. Another type of security system that has received recent attention is the coded electronic digital lock. This type of lock eliminates the need for a key lock mechanism, and effects a locking device that is substantially more tamper proof than the mechanical type of lock. This type of lock, which normally operates in response to operation of a plurality of buttons in predetermined sequence of a keyboard, can be simply and easily coded and the code can be changed by the owner.

Other variations of such security systems include alternating current operated systems which operate from standard 110 volt alternating current, and battery operated systems which include a self-contained battery operated power supply. Some systems are provided with supervisory circuitry for automatically monitoring the operability of the system. Some of these systems provide a single audible alarm in response to any type of security breach while others produce different signals in response to different types of breaches such as intrusion and/or fire.

Some of the prior art security systems incorporate relays and other electro-mechanical devices that are prone to failure, some systems require substantial amounts of power for operation, other systems utilize batteries that must be periodically replaced and while some of the systems provide for the detection of more than one type of security breach, there still exists a need for an integrated, broad spectrum security system that will provide for detection against both intrusion and fire, is adaptable to a wide variety of security breach sensors, and provides all of the auxiliary security functions including a coded digital lock, system supervision, monitor and test with auditory and visual indicators, fail-safe energy source, lower power requirements, reliability, and the like.

SUMMARY OF THE INVENTION

Broadly, the present invention is a fully integrated security system that includes a closed loop intrusion detection circuit, a closed loop fire detection circuit, a coded digital electronic lock circuit, and alternating current-direct current power supply with an integral battery charging circuit, a system supervision circuit, positive security breach latching circuits, and a multiple tone audible alarm generator. The system can accommodate a wide variety of security breach sensors including a floor mat sensor, can be coupled to an automatic telephone dialing device, and provides all of the desirable auxiliary features for such a system including a convenient system disarming circuit for permitting exit from a dwelling in which the system is installed. The entire system is fabricated from solid state components and micro-electronic circuits. Unnecessary redundancy in the circuit is eliminated and because the circuit is entirely solid state, it possesses exceptionally high reliability and low power consumption. Once the basic system has been installed it can be expanded to incorporate additional sensing devices with ease and economy.

In one embodiment of the invention, the security system comprises a power supply means for generating a continuous system energizing signal, an intrusion sensing means including at least one intrusion responsive switch and means operable between normal and active conditions in response to operation of the intrusion responsive switch for generating a "secure" and an "intrusion" signal, respectively. Manually operable exit timing means are provided for generating an exit signal for a predetermined period of time in response to operation thereof. The system further includes a lock disarming circuit means having a plurality of individually operable switches, a sequential latching circuit, a timing circuit and a sequence programming circuit operatively connected thereto for generating a lock disabling signal in response to operation of said switches individually in a predetermined sequence and within a predetermined period of time. Arming circuit means are coupled to the power supply means and the disarming circuit means to receive the energizing and disarming signals, respectively, for generating an arming signal in response to the energizing signal and the absence of the lock disabling signal and for generating a disarming signal in response to the energizing signal and the lock disabling signal. An intrusion latching circuit means is coupled to the arming circuit means to receive the arming and disarming signals and to the intrusion sensing means to receive the "secure" and "intrusion" signals, and to the exit timing means to receive the "exit" signal, for generation of an intrusion alert signal in response to the simultaneous occurrence of the arming signal and the "intrusion" signal and the absence of the "exit" signal.

Also provided is a pyrogenic-sensing means including at least one pyrogenic condition responsive device coupled to the energizing means for generating a fire alarm signal in response to a pyrogenic condition, such as smoke, fire, heat, or the like, and a pyrogenic-latching means coupled to the pyrogenic-sensing means to receive the fire alarm signal for generating in response thereto a continuous fire alert signal. Tone signal generating means are coupled to the intrusion and pyrogenic-latching circuit means to receive the intrusion alert and the fire alarm signals, respectively, for generating audio frequency tone signals in response thereto. The tone signal generating means includes a tone signal modulating means operable in response to the intrusion alert signal for generating a frequency modulating signal and operable in response to the fire alert signal for generating a different modulating signal. A free running multivibrator circuit including a frequency determining circuit is coupled to the modulating means to receive the modulating signals. The multivibrator circuit is responsive to the modulating signals for generating a constant audio frequency signal having distinctive audio characteristics. Coupled to the tone signal generating means is an audible signal generating means including at least one loudspeaker and being coupled to the tone signal generating means to receive the modulated audio frequency signals and generate in response thereto an audible signal characteristic of each alarm condition.

In another embodiment of the invention, the system further includes floor mat means having a pressure responsive switch for sensing the presence of an intruder. The system further includes an alternate intrusion latching circuit means coupled between the floor mat means and the tone generating means for generating another intrusion signal and applying the same to the tone generating means.

In yet another embodiment of the invention, the power supply means includes means for applying a signal to the pyrogenic-sensing means for testing the operability thereof and for generating a system defect signal in response to nonoperability thereof.

In a further embodiment of the invention, the power supply means includes a self-contained battery energizing system, a battery charging circuit coupled thereto, and manually operable means for applying a simulated load to the battery and generating a signal indicative of the condition thereof.

It is therefore an object of the invention to provide an improved integrated security system.

It is another object of the invention to provide an improved security system which includes means for sensing breaches of security resulting from fire, intrusion, and including digital electronic circuitry for controlling access to the secured area.

Still another object of the invention is to provide an improved security system that is entirely solid state and utilizes micro-electronic circuits.

Yet another object of the invention is to provide an improved security system which includes means for detecting the presence of an intruder.

Still another object of the invention is to provide an improved security system which includes means for disarming the system from within the protected premises for a predetermined period to permit exit therefrom.

A further object of the invention is to provide an improved security system having a multiple tone signal generator which includes a free running multivibrator and a modulating circuit coupled thereto for modulating the output thereof to produce a plurality of different alarm tone signals.

Yet a further object of the invention is to provide an improved security system which includes circuitry compatible with a wide variety of security breach sensors including those for sensing fire, intrusion, and the like.

A still further object of the invention is to provide an improved security system which includes a digital electronic lock circuit which can be programmed to disarm the security system in response to operation of the buttons of a keyboard in a predetermined and alterably coded sequence.

Another and further object of the invention is to provide such a security system wherein the digital electronic lock circuitry must be operated within a pedetermined period of time to effect disarming of the system.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF A PREFERRED EMBODIMENT

Figure 1A:
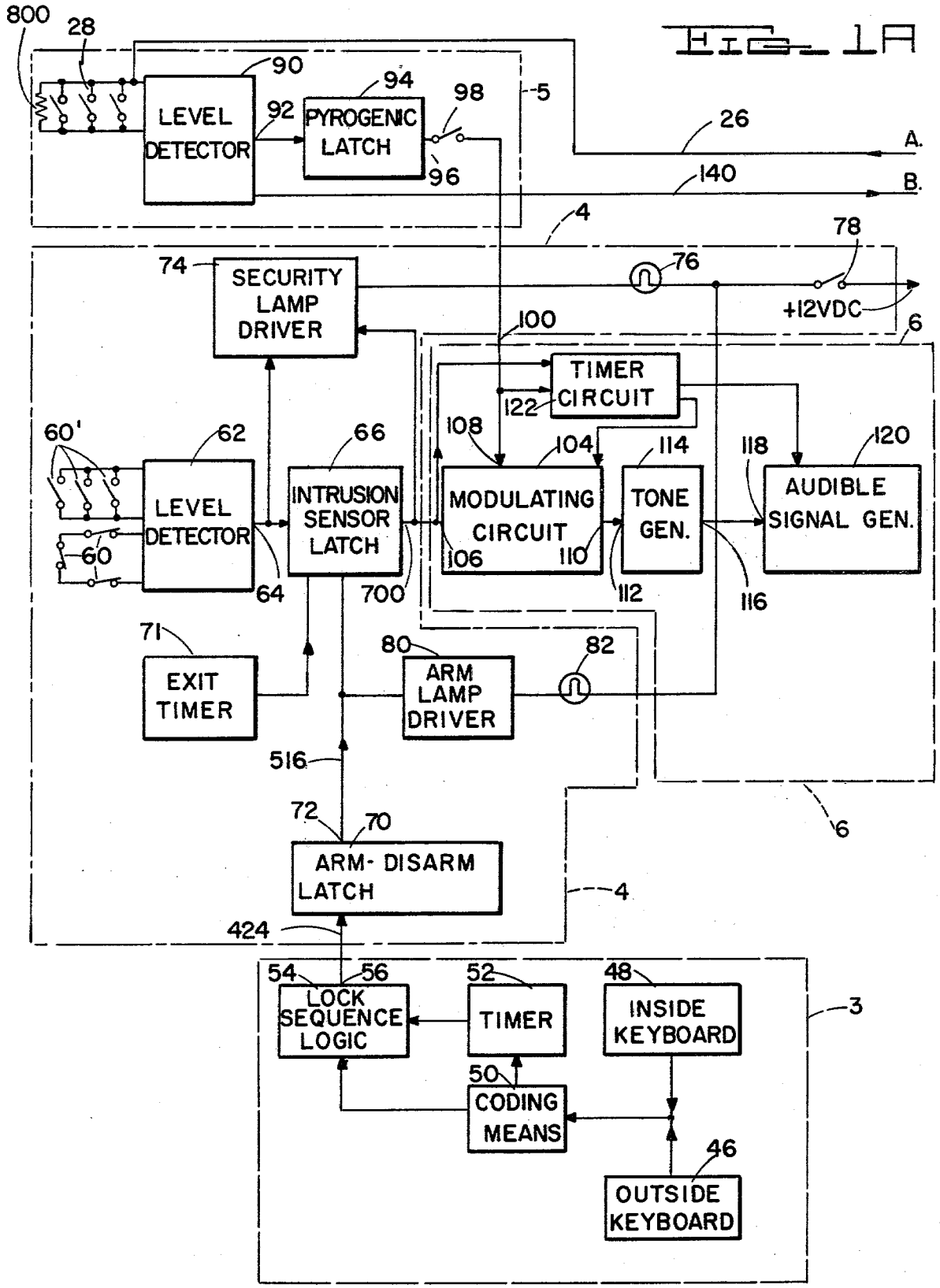
FIGS. 1A and 1B show a block diagram of a security system in accordance with the present invention.
Figure 1B:
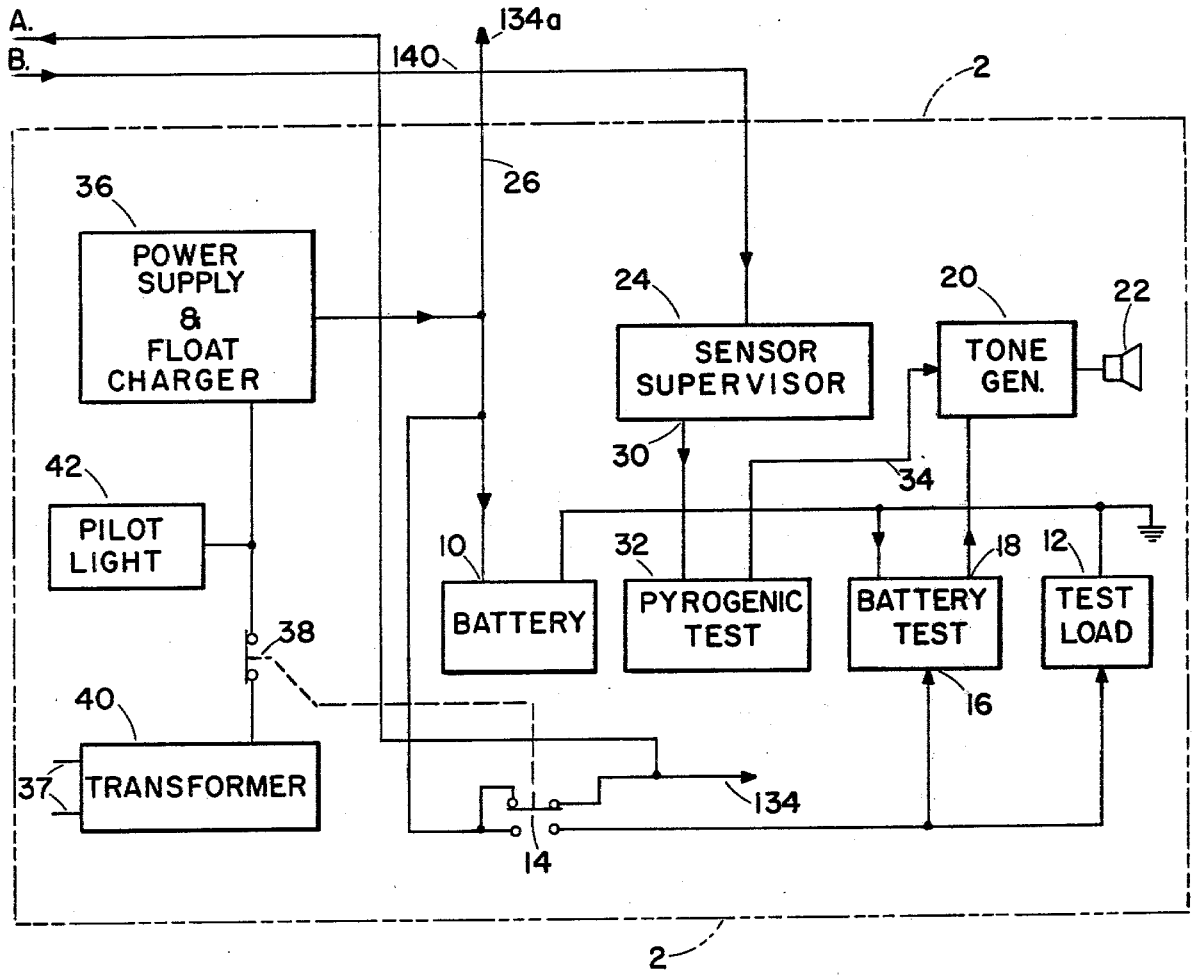

Referring now to the drawings, there is shown in FIGS. 1A and 1B a block diagram of a security system in accordance with the present invention. The system comprises a power supply-supervisory circuit in dashed box 2, which provides a means for energizing the system and monitoring operation of portions thereof; an electronic digital lock circuit in dashed box 3 which provides a means for disarming the security system to permit entry into secured premises in response to operation thereof as will be explained below; a system arm-disarm latching circuit and intrusion latching circuit in dashed box 4 which provides means for arming the intrusion alarm circuit and responding to a violation thereof to generate an alarm signal; a fire or pyrogenic condition sensing circuit in dashed box 5 for sensing and generating an alarm signal in response to a pyrogenic condition such as fire, heat or smoke; and tone generating means and audible signal generating means in dashed box 6 responsive to a security breach of the system for generating auditory and/or visual alarm signals.

Broadly, the system energizing and supervisory circuit 2 includes a rechargeable battery 10 as the secondary source of direct current operating potential for the system. Battery 10 is connected to a test load 12 via a normally open test switch 14. A battery condition test circuit 16 is connected across battery 10 and test load 12 when switch 14 is closed and is responsive to the condition of battery 10 for generating a signal indicative of the battery condition at its output terminal 18. This condition signal is applied to a tone generator 20 which is in turn connected to a loudspeaker 22 to generate an audible signal indicative of the battery condition.

Circuit 2 further includes a pyrogenic sensor-supervisor circuit 24 which receives a test signal via line 140 from pyrogenic sensors 28 of circuit 5. Circuit 24 automatically generates a signal at its output terminal 30 in the event of a failure of a pyrogenic sensor 28 other than a breach thereof caused by a pyrogenic condition. This signal is applied to pyrogenic test circuit 32 which generates and applies a signal via conductor 34 to tone generator 20 and loudspeaker 22. Preferably, the tone signals generated in response to the operation of circuits 16 and 32 are different is sound to facilitate distinguishing therebetween.

Circuit 2 further includes power supply and float charger circuit 36 which is connected to source 37 of alternating current potential (not shown) via test and reset switch 38 and voltage reducing transformer 40. Pilot light 42 is provided for indicating operation of the alternating current source. Circuit 36 is connected to battery 10 and applies a charging current thereto whenever the charge thereon drops below a predetermined level. Circuit 2 provides an "unswitched" B+ voltage to line 134*a* and "switched" B+ voltage to line 134. "Unswitched" means that the B+ voltage does not go through switch 14.

The digital electronic lock circuit 3 comprises, broadly, a pair of keyboards 46, 48 connected in parallel to coding means 50. Coding means 50 in turn connects keyboards 46, 48 to timer circuit 52 and to sequential logic circuit 54. Keyboards 46, 48 each comprise a plurality of normally open pushbutton switches with each switch of a keyboard being identified with a different indicia, typically the numbers zero through nine. The push button switches utilized with keyboards 46, 48, and other push button switches in the drawings, are monostable switches having a "stable" position, to which the button automatically reverts after a push actuation, and an "unstable" position to which the button or switch is positioned during a push actuation and only for the duration of the push actuation. Sequential circuit 54 includes a plurality of enabling circuits that are interconnected such that individual ones thereof must be activated in a predetermined sequence. Sequential circuit 54 is further connected to timer 52 such that circuit 54 is activated only when the timer 52 has first been activated. Coding means 50 connects the switches of keyboards 46, 48 to timer 52 and circuit 54 such that timer 52 and individual ones of the enabling circuits of circuit 54 are coupled to predetermined ones of the pushbutton switches of keyboards 46, 48. Correspondingly, timer 52 and enabling circuits of circuit 54 can be operated only in response to manual operation of the switches of keyboards 46, 48 in a predetermined sequence determined by coding means 50. Operation of switches of keyboards 46, 48 in this predetermined sequence will cause sequential circuit 54 to generate a disarming signal at its output terminal 56.

The arming-disarming circuit and intrusion latching circuit 4 hereinafter referred to as the intrusion channel 4, comprises broadly a plurality of intrusion sensing devices 60 for sensing an unauthorized intrusion into the premises. Devices 60 may comprise normally closed switches 60 or normally open switches 60' operatively coupled to windows, doors, and the like and which are automatically operated to open or closed conditions in response to opening of the window, door, etc. Devices 60 may also include ultrasonic sensing devices, light beam sensors, motion detecting devices, pressure switches, and the like, many such sensing devices being commercially available, the only requirement being that the device have either a normally open or a normally closed switch therein which operates in response to a breach thereof. The switches are electrically isolated from one another so that each switch acts independently from the other switches to signal a breach. Devices 60 are operatively connected to level detector circuit 62 which generates an electrical signal at its output terminal 64 in response to operation of one or more of devices 60 from their normal to their breached conditions. It will be observed that devices 60 can be connected alternatively in series or in parallel, level detector circuit 62 being adapted to operate with both types of electrical connections as will be explained below. Output terminal 64 is in turn connected to intrusion sensor latch circuit 66. Circuit 66 is operable between a normal first state in the absence of a signal at terminal 64 and is responsive to a signal at terminal 64 to operate into a second state. Once it is operated from its first to its second state, circuit 66 remains in its second state indefinitely until the circuit is manually reset to its first state.

Intrusion channel 4 further includes system arming-disarming latch circuit 70 which is connected to terminal 56 of the sequential lock circuit 54. Arming-disarming latch circuit 70 is connected to energizing means 2 via an arming switch (not shown in FIG. 1) such that when the arming switch is closed, arming-disarming latch circuit 70 operates to generate continuously at its output terminal 72 a system arming signal. Circuit 70 is further responsive to the signal from sequential lock circuit 54 for operating into a second state in which the signal appearing at output terminal 72 is canceled. Intrusion sensor latching circuit 66 is in turn operatively coupled to arm-disarm latch circuit 70 such that intrusion latch circuit 66 is rendered inoperative in the absence of the signal at output terminal 72. Intrusion channel 4 may further be provided with a security lamp driver circuit 74 connected to the output of level detector 62 and electrically in series with an intrusion channel security light 76 and a system status switch 78 (in the energizing means 2) such that the light 76 will be illuminated upon closure of status switch 78 only if all of the intrusion sensing devices 60 are in their normal or unbreached condition.

The pyrogenic sensing and latching circuit 5 hereinafter referred to as the pyrogenic channel comprises the pyrogenic sensing elements 28 which are electrically connected to a pyrogenic sensing device level detector 90 having output terminal 92. The pyrogenic condition sensing devices 28 are again available commercially in a variety of configurations whereby the elements will respond to pyrogenic conditions such as fire, smoke, heat, and the like, the only requirement being that each of the devices include a switch 28, also electrically isolated from one another, that operates to a non-normal condition in response to the condition to be sensed. Devices 28 may be connected in parallel, level detector circuit 90 being provided with inputs from the switches. It will be understood of course that this circuit will also operate for normally closed series connected switches. In response to operation of one or more of devices 28, level detector circuit 90 generates an output signal at its output terminal 92. This signal is applied to pyrogenic latch circuit 94. Circuit 94 responds to a signal at output terminal 92 to operate from a normal condition to a second condition. Circuit 94 remains in this second condition until it is manually reset. Latch circuit 94 in turn generates a signal at its output terminal 96 which signal is transmitted via on-off switch 98 to one input terminal of tone generating and audible signal generating circuit means 6.

Audible signal generating circuit 6 comprises broadly modulating circuit 104 having two inputs 106, 108 connected to intrusion sensor latch circuit 66 and pyrogenic latch circuit 94, respectively. Modulating circuit 104 is responsive to input signals at its terminals 106, 108, respectively, to generate two different tone modulating signals at its output terminal 110. These two signals are applied to input terminal 112 of tone generator circuit 114. Tone generator circuit 114 is responsive to a frequency modulating signal to generate an output signal of variable frequency. Tone generator 114 includes a power driver circuit and its output signal appears at its output terminal 116 from which it is applied to input terminal 118 of audible signal generating means 120. The signals from the intrusion sensor latch circuit 66 and pyrogenic latch circuit 94 are applied to modulating circuit 104 which is in turn connected to tone generating circuit 114. Timer circuit 122 is connected to modulating circuit 104 and audible signal generator 120 and is operable in response to a signal from the intrusion sensor latch circuit 66 to intermittently turn the audible signal generating means 120 "on" and "off". Modulating circuit 104 produces two distinctly different signals in response to a breach of intrusion channel 4 or a breach of pyrogenic channel 5 respectively.

Figure 2:
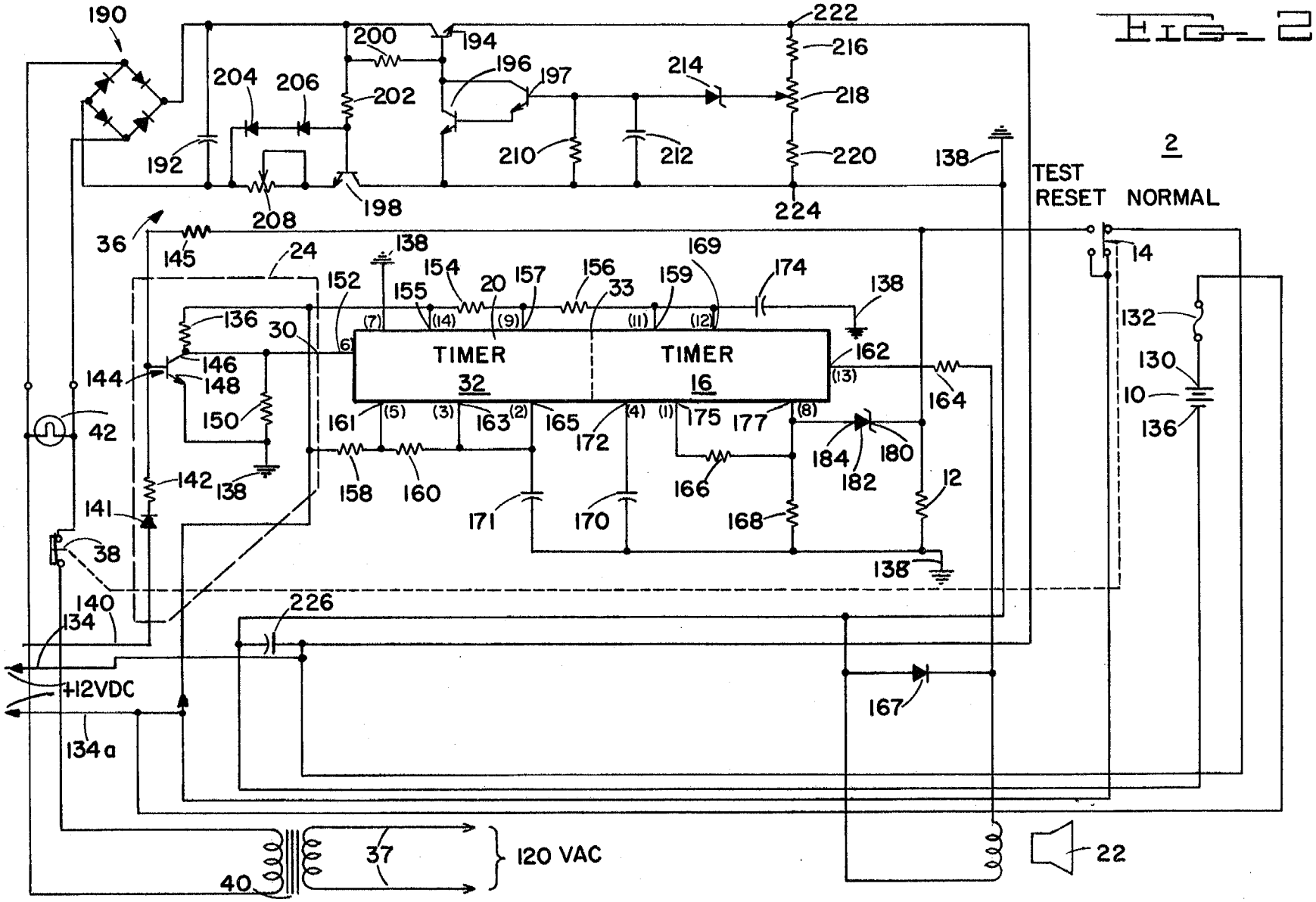
FIG. 2 is an electrical schematic diagram of a power supply and system monitoring circuit which forms a part of the present invention.

Referring now to FIG. 2, system energizing and supervisory circuit 2 comprises rechargeable battery 10, preferably a lead calcium gelled electrolyte rechargeable battery or the like, incorporating and having its positive terminal 130 connected via fuse 132 to output terminal 134*a* which will hereinafter be referred to as B+ terminal 134*a* and is a source of unswitched B+ voltage. Negative terminal 136 of battery 10 is coupled to common ground 138, which may be a chassis ground.

Means 32 comprises a portion of an XR2556 dual timing circuit manufactured by EXAR Integrated Systems, Inc., which contains two independent 555-type timers on a single monolithic chip.

A "555" timer is known to the art and, very generally, comprises a circuit having a Vcc pin, a control voltage pin, a reset pin, a trigger pin, an output pin, a discharge pin and a threshold pin. By connecting a capacitor between a common connection of the threshold pin and discharge pin and ground and by connecting a resistor from the aforesaid common connection to a second common connection of the reset, Vcc pins, and a voltage source, a monostable or time delay circuit is obtained, with the period of time delay determined by the values of the resistance and capacitance. The same "555" timer may be used as an astable or free running oscillator by making the following connections of a capacitor and two resistors; one side of the capacitor to a common connection of the trigger and threshold pins and the other side to ground; one resistor between the threshold and discharge pins and a second resistor connected from the discharge pin to a common connection of the reset pin, Vcc pin, and a source of V+. Proper selection of the values for the resistors and capacitance determines the frequency of the free running oscillator.

In the description that follows the pins for the timers 244 (FIG. 3C), 730 (FIG. 5), 906 (FIG. 7B), and 1032 (FIG. 7A), are numbered and the pin members, which are in parenthesis, represent the following:

(1)—Ground
(2)—Trigger
(3)—Output
(4)—Reset
(5)—Control
(6)—Threshold
(7)—Discharge
(8)—Vcc.

In all timers in this specification, the output terminal is a source of positive voltage approaching the supply voltage and also a sink approaching ground potential.

For timer circuit 33 in FIG. 2, the numbered pins represent the following:

(1)—Output
(2)—Trigger
(3)—Threshold
(4)—Control
(5)—Discharge
(6)—Reset
(7)—Ground
(8)—Reset
(9)—Discharge
(10)—Control
(11)—Threshold
(12)—Trigger
(13)—Output
(14)—V+.

The above circuits are discussed in more detail in the following publications:

Signetics 555, 556 Product Data Sheets © 1973 Signetics Corp., pages 6–49 to 6–51

XR-2556 Dual Timing Circuit—Product Data Sheet EXAR Integrated Systems, Inc., 750 Palomar Avenue, Sunnyvale, California 94086, Copyright 1973.

In the present circuit, resistors 154, 156 are connected between "supply", "discharge" and "threshold" terminals 155, 157, and 159, respectively, as shown and resistors 158, 160 are connected between B+ terminal 134, "discharge" terminal 161, and the common connection of "threshold" and "trigger" terminals 163 and 165. Capacitor 171 is connected between "trigger" terminal 165 and ground 138. Terminal 152 is a "reset" terminal and a ground signal applied thereto renders timer circuit 32 inoperative. In the event of a defect in the wiring to pyrogenic sensors 28, the voltage applied to base 143 of transistor 144 drops rendering transistor 144 nonconductive. This in turn applies a positive voltage to terminal 152 rendering timer 32 operative. The circuit connected as shown, functions as an oscillator. The positive voltage on terminal 152 allows timer 32 to generate a 0.25 hz. wave which is a waveform which swings from zero to positive supply voltage at 2 second intervals. This waveform is present at output pin 175 which is connected to reset pin 177 through resistor 166. Whenever pin 177 is positive, timer section 16, discussed below and which is free running at 900 hz. emits a 900 hz. signal at output 162 and when the signal at pin 177 is zero, there is no signal at output 162. This cycle repeats to generate a 2 second on, 2 second off intermittent oscillatory signal of 900 hertz at output terminal 162. This signal is applied via resistor 164 to the coils of conventional loudspeaker 22 to produce a "BEEP" tone.

Battery test circuit 16 also incorporates parts of both portions of the dual timing circuits of the aforementioned XR-2556 dual timing circuit. Connected across "output" and "reset" terminals 175, 177 of circuit 16 is resistor 166 and "reset" terminal 177 is connected to ground 138 via resistor 168. Terminal 172 of circuit 16 is also connected to ground 138 via capacitor 170. Capacitor 174 is connected between the common connection of pins 159, 169 and ground 138. Thus configured, circuit 16 also functions as an oscillator. Switch 14 is one-half of a double pole, double-throw test and reset monostable switch, the other half being switch 38. In operation, when switch 14 is moved from its "normal"

position as illustrated to its "test reset" position, the d.c. power to line 134 is interrupted, which, as will become apparent, interrupts B+ voltage to the pyrogenic latching circuits and resets pyrogenic latch 94 to be responsive to an alarm signal. Switch 38 is also moved to its alternate position, disconnecting the a.c. power to bridge circuit 190. The voltage of battery 10 is applied to cathode 180 of zener diode 182. Anode 184 of diode 182 is connected to the common connection of resistors 166, 168. The battery potential is also applied to resistor 12 to thereby load the battery 10. If the battery potential and energy reserve is sufficient, zener diode 182 breaks down permitting current to flow from cathode 180 to anode 184 thereof to apply a voltage to "reset" terminal 177. This permits circuit 16 to operate and generate a steady (900 hz.) signal at output terminal 162. This signal is again applied to speaker 22 to produce a steady tone signal indicating that battery 10 is in good condition.

Also, when switch 14 is in the "test/reset" position, B+ voltage from battery 10 is applied through resistor 145 to base 143 of transistor 144 to maintain resistor 144 conductive and timer 32 operative during battery test.

Diode 167 is placed across the coil of speaker 22 and acts as an inductive surge suppressor.

Battery charging circuit 36 includes a full wave rectifier 190 connected to the secondary of transformer 40. Filter capacitor 192 is connected across the output thereof. A transistorized regulating circuit is connected across capacitor 192 and includes transistor 194, Darlington pair transistors 196, 197, current limiting transistor 198, biasing resistors 200, 202, diodes 204, 206, and adjustable resistor 208. The output circuit of the regulator circuit includes resistor 210, capacitor 212, zener diode 214, and an adjustable voltage divider circuit including resistors 216, 218 and 220. The output of the charging circuit appears at terminals 222, 224 and filter capacitor 226 is connected thereacross. This output is in turn applied to the battery terminals 130, 136. An indicator lamp 42 is connected across the input of rectifier 190 to provide a visual indication that the charging circuit is energized.

Figure 6:
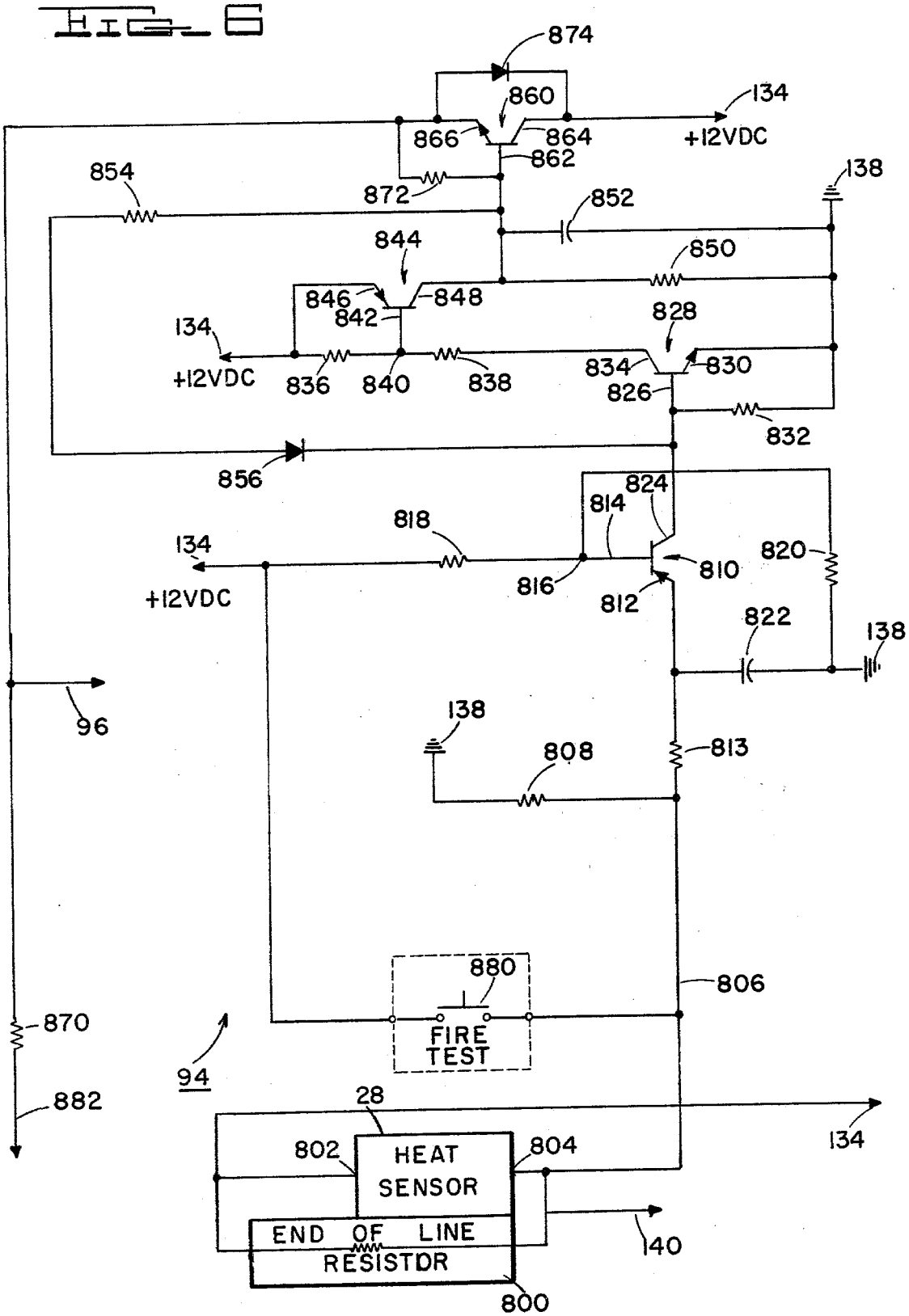
FIG. 6 is an electrical schematic diagram of the pyrogenic-latching circuitry for use in the present invention.

The B+ "switched" voltage from terminal 222 and line 134 is applied via connecting circuit 26 to all of pyrogenic sensing means 28 (FIGS. 1 and 6). This voltage is sensed from pyrogenic sensing means 28 via conductor 140. The sensed voltage on conductor 140 is applied via diode 141 and resistor 142 to base 143 of transistor 144 of sensor-supervisory circuit 24. The function of diode 141 is to keep a positive charge from accumulating on capacitor 822, FIG. 6, and thereby prevent false latching. Transistor 144 has its collector 146 connected to B+ terminal 134 through resistor 136 and its emitter 148 connected to ground 138. Load resistor 150 is connected between collector 146 and emitter 148. When pyrogenic sensors 28 are normal, the potential on base 143 is high and transistor 144 is conductive. Because of the relatively low voltage drop across transistor 144 when conductive, a ground signal is applied to input terminal 152 of the pyrogenic test circuit sensing means 32.

Figure 3A:
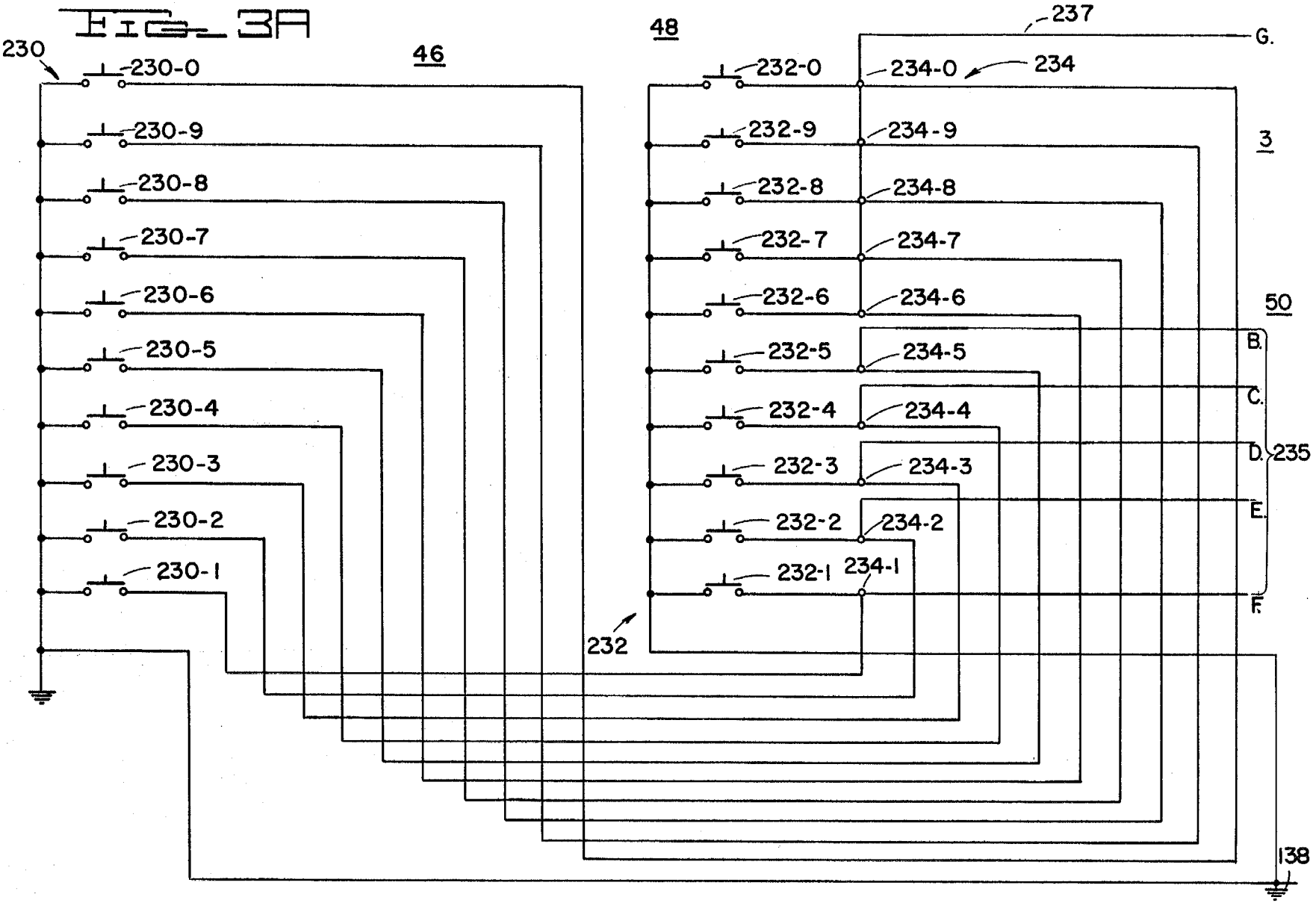
FIGS. 3A, 3B and 3C show an electrical schematic diagram of the electronic digital lock portion of a security system in accordance with the present invention.
Figure 3B:
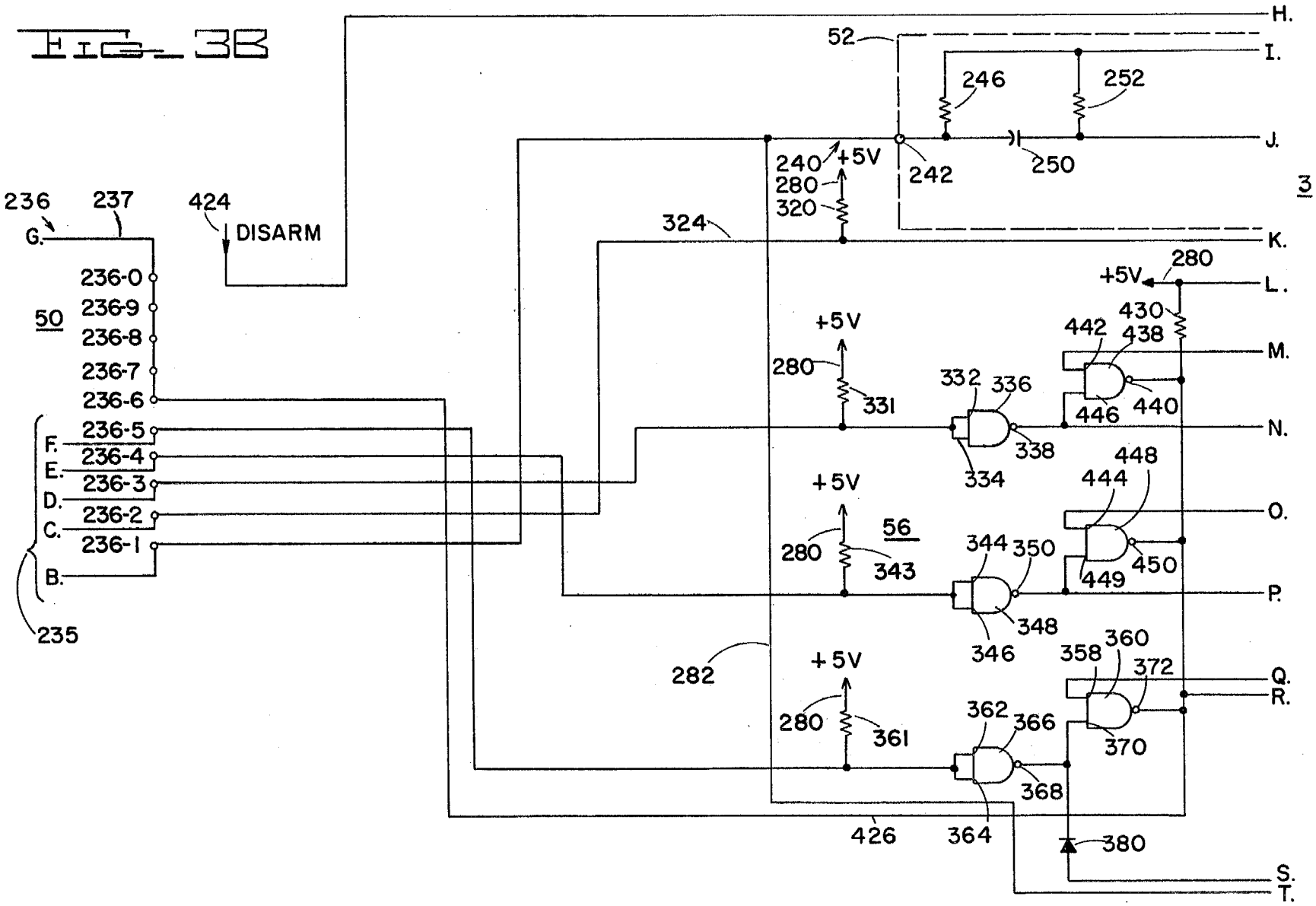
Figure 3C:
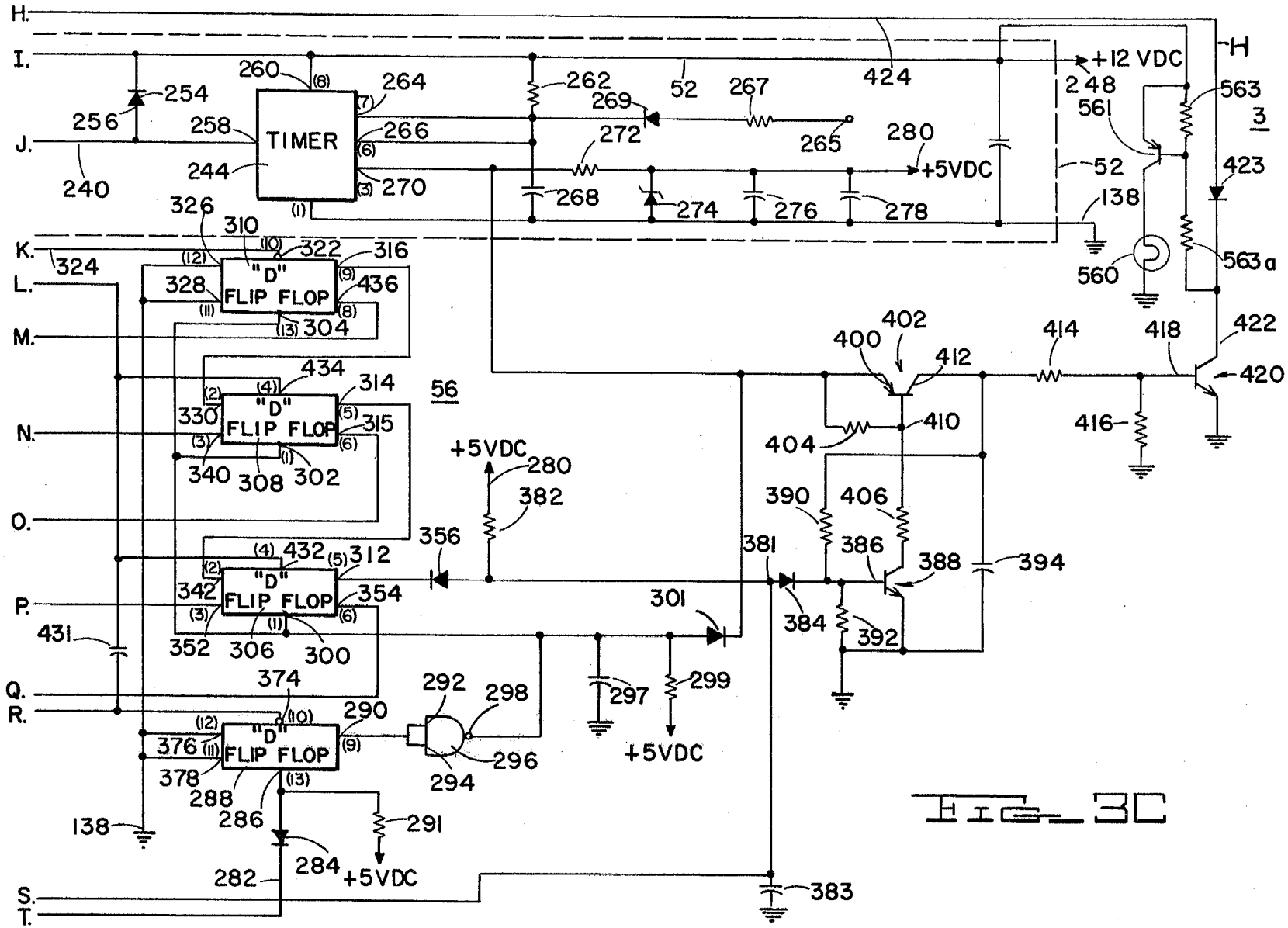

Referring now to FIGS 3A–3C, there is shown the circuit for digital electronic lock means 3. Means 3 includes first and second sets 230, 232 of manually operable pushbutton switches 230-1, 230-2, 230-3, 230-4, 230-5, 230-6, 230-7, 230-8, 230-9, and 230-0 and 232-1, 232-2, 232-3, 232-4, 232-5, 232-6, 232-7, 232-8, 232-9, and 232-0 respectively. Each of the switches of sets 230, 232 is a normally open, single pole switch preferably operable by means of a pushbutton (not shown). Preferably, each of the pushbuttons is provided with indicia distinguishing each pushbutton of each set from all of the other pushbuttons of the same set. Sets 230, 232 are connected in parallel and set 232 is mounted within the secured premises and set 230 is mounted externally of the premises. Only pushbuttons 230 are mounted outside of the premises, making unnecessary a highly secure protective housing. Individual ones of the pushbuttons of sets 230, 232 are individually connected to predetermined ones of a plurality of sockets 234-1, 234-2, 234-3, 234-4, 234-5, 234-6, 234-7, 234-8, 234-9, and 234-0. The opposite terminals of each of the switches of sets 230, 232 is connected to ground 138. A second plurality of socket elements 236 is provided, sockets 236 being mounted adjacent sockets 234. Sockets 236 again include a plurality of ten individual sockets 236-1 through 236-0 with sockets 236-6 through 236-0 being connected electrically in common. A plurality of jumper wires are provided to electrically connect selected ones of sockets 234-1 through 234-0 to selected ones of sockets 236-1 through 236-0. For purposes of explanation, it will be assumed that socket 234-5 is connected to socket 236-1, socket 234-4 is connected to socket 236-2, socket 234-3 is connected to socket 236-3, socket 234-3 is connected to socket 236-3, socket 234-2 is connected to socket 236-4 and socket 234-1 is connected to socket 236-5, as shown for example by lines 235. The remaining ones of sockets 234-6 through 234-0 are connected to the commonly connected ones of sockets 236-6 through 236-0, as shown for example by line 237. It will, of course, be apparent that the sockets can be connected in any desired order whereby manipulation of individual ones of the pushbuttons 230-1 through 230-0 or 232-1 through 232-0 will apply a ground signal to selected different ones of the sockets 236-1 through 236-0. In this manner the "combination" for disarming the intrusion alarm system may be readily changed. Correspondingly, it will be seen that sockets 234, 236 and the associated jumper cables 235, 237 comprise the coding means 50 which enables pushbuttons 230, 232 to apply signals to different ones of sockets 236 in accordance with the interconnections therebetween.

In the illustrated example, electronic lock circuit means 3 is coded to open in response to the operation of either pushbutton set 230 or 232 when the switches thereof are operated in the sequence of 230-5, 230-4, 230-3, 230-2, 230-1 or 232-5, 232-4, 232-3, 232-2, and 232-1. In the following discussion the buttons 230-5 to 230-1 will be referred to, it being understood that corresponding 232 series buttons could likewise be activated. Forming a part of circuit 52 is timer 244 which may be a "555" timer as previously mentioned.

Resistor 246 is connected between input terminal 242 and B+ supply terminal 248, the latter being connected to B+ supply terminal 134 (FIG. 2). Capacitor 250, resistor 252, and diode 254 are connected to input terminal 242 as shown to form a differentiating circuit. The output of the differentiating circuit appears at anode 256 of diode 254 and this signal is applied to trigger input terminal 258 of timer 244. Supply terminal 260 of timer 244 is connected to supply terminal 248. Resistor 262 is connected between supply terminal 248 and "threshold" terminal 266 of timer 244. Terminal 266 is connected directly to "discharge" terminal 264 of the timer 244, and the latter is connected to ground 138 through capacitor 268. Thus configured, timer 244 functions as a monostable timer circuit having output terminal 270.

The output signal appearing at terminal 270 is at essentially zero volts DC. When a pulse (negative going) is applied to trigger terminal 258, the output at terminal 270 goes positive to approximately 12 volts and remains positive for a period of time determined by resistor 262 and capacitor 268. At the end of the timing period, output terminal 270 returns to approximately zero volts. Output terminal 270 has connected thereto a filter and voltage limiting circuit comprising resistor 272, zener diode 274, which breaks down at +5 volts, and capacitors 276, 278. These components are connected to limit and filter the voltage signal from terminal 280 to a +5 volt DC signal. In the illustrated and a working embodiment of the invention, resistor 262 and capacitor 268 are selected to provide a timing period of about 15 seconds whereby a +12 volt direct current signal will appear at terminal 270 for a period of 15 seconds in response to the momentary closure of push-button 232-5 or 230-5.

Also forming a part of the lock sequence logic circuit 56 are "D" type edge triggered flip-flops 288, 306, 308 and 310; flip-flops 288 and 306 may be contained in a dual-in-line flip-flop having the designation Model No. ITT-7474, described in ITT Semiconductors Product Catalog 1974, pages 3–99 ff. while flip-flops 308, 310 may be contained in a second dual-in-line device of the same type.

Flip-flop circuits 288, 306 and 308, 310 have their terminal designated as pin numbers which are shown in parenthesis and correspond to those cited in the foregoing publication and are as follows:

| Flip-flop Circuit 306, 308 | Flip-flop Circuit 288, 310 |
|---|---|
| (1) - Clear | (8) - $\overline{Q}$ |
| (2) - D | (9) - Q |
| (3) - Clock | (10) - Preset |
| (4) - Preset | (11) - Clock |
| (5) - Q | (12) - D |
| (6) - Q | (13) - Clear |

In general, in the operation of each of flip-flop circuits 288, 306, 308, 310, when the preset pin goes to logic 0, Q output goes to logic 1; and when the clear pin goes to logic 0, Q output goes to logic 0, both of these control functions being independent of the clock input. When the D input goes 0, 1, the Q output will go 0, 1, respectively, but only on the next clock signal. The $\overline{Q}$ output is opposite to the Q output.

Also, for each NAND gate 276, 336, 348, 366, 428, 448 and 360 when both inputs are a logic 1, the output is a logic 0; under all other input combinations, the output is a logic 1.

Operation of the first button 230-5 applies ground to terminal 236-1, causing a negative going pulse to develop across capacitor 250, and thence to trigger pin 258 of timer 244, thus starting timer 244. At the same time, a 0 input is applied to flip-flop 288 clear pin 286 through diode 284, thus setting Q output 290 of flip-flop circuit 288 to 0, which is applied to the inputs of NAND gate 296, generating a "1" at output 298, charging capacitor 297. Diode 284 blocks the 12 V present on line T from flip-flop 288 clear terminal 286. Flip-flop circuit 310 clear pin 304, flip-flop circuit 308 clear pin 302 and flip-flop circuit 306 clear pin 300 are initially held at logic 0 until capacitor 297 charges. "Q" outputs 316, 314, and 312 of flip-flop circuits 310, 308 and 306, respectively, are therefore set at logic zero. When capacitor 297 becomes charged, clear terminal pins 304, 302 and 300 will be held at logic 1, Q outputs 316, 314 and 312 remaining at 0.

Upon depressing button 230-4, a logic 0 will be applied through contact 236-2 to preset terminal 322 of circuit 310. This will change the state of "Q" output 316 from logic 0 to logic 1. This logic 1 is thence applied to set input 330 of circuit 308. This condition will cause "Q" output 314 of circuit 308 to change state with the next clock pulse at clock terminal 340. At the same time that logic 0 is applied to preset 322, circuit 310, $\overline{Q}$ output 436 will change from a logic 1 to a logic 0 state, thus applying a logic 0 to input 442 of gate 438.

Upon depressing the third button 230-3, a logic 0 signal is applied through contact 236-3 to gate 336 inputs 332 and 334 thus causing output 338 to change from logic 0 to logic 1, which is applied to input 446 of gate 438 and since input 422 is at logic 0, output pin 440 remains at logic 1. Dropping resistors 331, 343, and 361 are between +5 volts d.c. terminal 280 and the inputs to gates 336, 348 and 366, respectively. At the same time, the logic 1 from output 338 of gate 336 is applied to flip-flop clock pin 340 of circuit 308 thus changing the state of "Q" output 314 from logic 0 to logic 1, which is applied to set input 342 of circuit 306; thus, when circuit 306 receives the next clock pulse at pin 342, its "Q" output 312 will change state. $\overline{Q}$ output 315 of circuit 308 will also change from logic 1 to logic 0 thus applying a logic 0 to input 444 of gate 448.

Depressing the fourth button 230-2 applies a logic "0" through contact 236-4 to gate 348 inputs 344 and 346 thus creating a logic "1" at output 350 of gate 348, which is applied to gate 448 input 449, with output 450 remaining at logic "1". At the same time the logic "1" from gate 348 output 350 is applied to flip-flop circuit 306 clock input 352 therefore changing the state of "Q" output 312 from logic "0" to logic "1". $\overline{Q}$ output 354 also changes state from logic "1" which is applied to NAND gate 360 input 358. When circuit 306 "Q" output 312 changes to logic "1", the forward bias from diode 356 is removed.

Depressing the fifth button 230-1 applies through contact 236-5 a logic 0 to gate 366 inputs 362 and 364 thus causing a logic 1 at output 368 which is applied to gate 360 input 370. Since gate 360 input 358 is at "0" logic, the output at pin 372 will remain at logic 1. At the same time, the logic 1 from gate 366 output 368 removes a forward bias from diode 380. Thus, a forward bias is then applied to diode 384 (FIG. 3C) through resistor 382. Capacitor 383 is connected between the anode of diode 384 and ground. Capacitor 383 and resistor 382 cause a time delay during power or cycle to permit the circuit to stabilize. Diode 384 is connected to base 386 of transistor 388 which is rendered conductive when diode 384 conducts thus applying a bias to base 400 of transistor 402 which now becomes conductive which in turn applies a bias to the base of transistor 420 which in turn pulls collector 422 and line H to ground potential. Line H going to ground potential acts as a disarm signal for the perimeter intrusion and mat latch circuits, later described. Resistor 390 provides positive feedback to base 386 of transistor 388 thus providing a latching action.

Having entered the 5 digit combination in proper sequence, during the 15 second time interval, the system has been disarmed, and will remain disarmed until arm button 472 is actuated. Had any sixth button, 230-6, to 230-0, however, been entered instead of the proper fourth digit, for example, it can readily be seen that a logic 0 would be applied to flip-flop circuit 288 preset pin 374. This will result in "Q" pin 290 being set to a logic 1 which is applied to NAND gate 296 inputs 292 and 294, which will cause pin 298 to change state from a logic "1" to a logic "0". This logic "0" is therefore applied to clear terminals 300, 302, 304 of flip-flop circuits 306, 308, 310, respectively. Applying a logic "0" to the clear pins automatically sets the "Q" outputs 312, 314, and 316 to logic "0". As long as the clear inputs remain at "0", the "Q" outputs will remain at "0", therefore, preventing normal operation of the logic sequence logic circuits preventing a disarm signal. Hence, upon entering the first digit of the combination, all remaining digits must be entered in the proper sequence, except that previously entered digits may be re-entered in proper sequence.

Entering any digits ahead of normal sequence such as depressing button 230-2 ahead of button 230-3 will put the circuit in lock-out conditions as follows. By depressing button 230-2, a logic "0" is applied to gate 348 pins 344 and 346 generating a logic "1" at pin 350. This logic "1" is applied to gate 448 input 449. However, since the third button 230-3 had not been depressed, flip-flop circuit 308 pin 315 remained in its initial state, or logic "1", which is applied to NAND gate 448 input 444. With pins 444 and 449 both receiving a logic "1" signal, pin 450 will switch to a logic "0" state. This logic "0" is applied directly to circuit 288 preset pin 374 through line R. This will cause "Q" pin 290 to change to a logic "1" state thus applying a logic "1" to gate 296 pins 292 and 294 which in turn will switch output 298 to a logic "0". This logic "0" is applied directly to the clear terminals 300, 302 and 304 of flip-flop circuits 306, 308 and 310, respectively, thus rendering the circuits inoperable, as previously described, until the first button 230-5 of the combination is depressed. Also, diode 301 discharges capacitor 297 after timer 244 times out, so that proper reset will occur when the first button of the combination is depressed.

It will be seen that entering the proper combination in the proper sequence, the circuit will disarm the system. After entering the first digit the entry of any other number of the combination ahead of normal sequence, or entering any digit that is not a part of the combination, will cause an error that will render the circuit inoperative until the first digit of the combination is re-entered again. However, after entering the first digit, if a digit is entered in proper sequence more than once, e.g., depressing the third button twice before depressing the fourth button, this is not recognized as an error, and it will not render the circuit inoperative to disarm. In addition, if the combination has been started and, for example, the first four digits have been correctly entered, re-entry of any of the previous digits in proper sequence starting with the second digit is permissible without causing an error condition.

Light 560, located outside the protected area indicates that the correct combination was entered on the digital panel and will remain "on" until timer 244 times out. Light 560 is connected between the collector of PNP transistor 561 and ground. PNP transistor 561 further has its base connected between voltage divider resistors 563 and 563*a*. Resistor 563*a* is connected to disarm line H while resistor 563 is connected to B+ line 248 which is also connected to the emitter of transistor 561. It will now be observed that when a ground signal appears on disarm line H in response to the disarm operation of the digital lock circuit 3, a ground connection is made through resistor 563*a* to the base of transistor 561, causing it to conduct placing B+ on its collector and on light 560. Diode 423 is placed in line H so that additional lock circuits 3 can be connected to disarm line "H" in parallel to diode 423 and transistor 420. Each lock circuit would operate independently of the other and line "H" could be disarmed by one circuit 3 without illuminating a lamp 560 of any other circuit 3.

A feature of this invention is that the only manner in which the system can be disarmed is by operation of the buttons on the digital panel in the proper sequence; hence, an intruder, once inside, cannot silence the alarm by operation of a manual switch.

It will thus be observed that the digital lock circuit 3 comprises timer 244 which permits 15 seconds for the circuit to be operated in a proper operating sequence. The circuit further includes a plurality of logic circuits connected for operation in a predetermined sequence. Operation of the circuit in the proper sequence will cause the same to generate a disarming signal at output terminal 424. Operation of any pushbutton out of the proper operating sequence will reset the logic circuit to its initial condition and the operating sequence must be restarted. The entire sequence must be completed within the timing period of timer 244. Pushbuttons 230, 232 can be connected in any sequence to terminals 236-1 through 236-6 whereby the proper operating sequence of the pushbuttons can be changed as desired by the user. Another feature of this invention is that any number of buttons may be operated prior to those which are operated in proper sequence that will disarm the system so that if there are any onlookers, they will be misled as to the "combination" needed for entry. Another feature of this invention is that prior to the operation of the first button in the digital lock sequence, the only power being consumed is that for timer 244 itself. No power is present in the gating or flip-flop circuits of the digital lock circuit.

Further, there can be a separate lock circuit 3 for each of several entrances, which circuits operate independently of one another to disarm the system.

Figure 4:
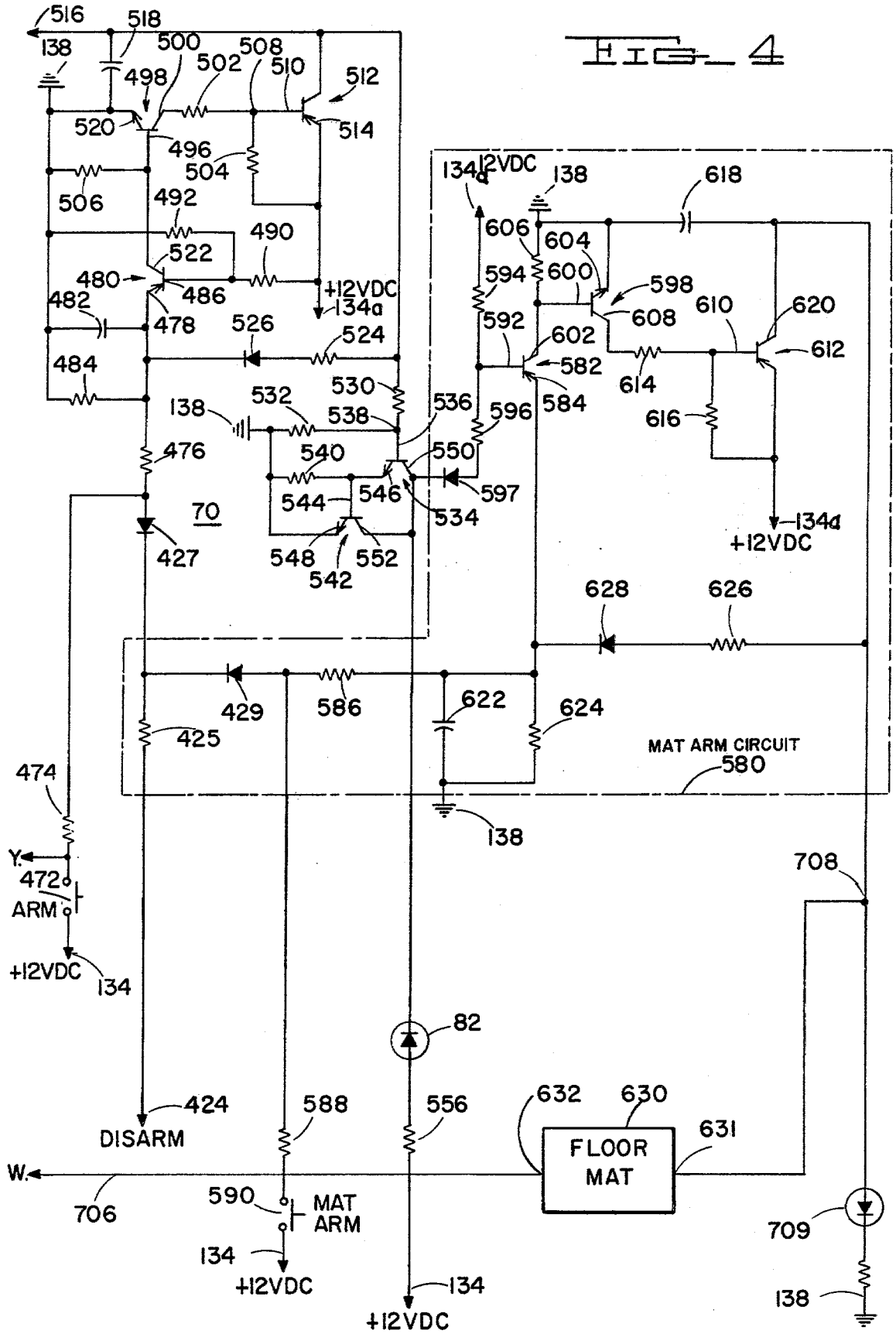
FIG. 4 is an electrical schematic diagram of the arming-disarming circuitry for use in the present invention.

Referring now to FIG. 4, the arming-disarming latch circuit 70 and the floor mat latch circuit which forms a portion thereof are shown in detail. Arming-disarming latch circuit 70 has an input terminal that is connected directly to B+ supply terminal 134 (FIG. 2). Connected electrically in series with terminal 134 is system arm switch 472 and resistor 474. When switch 472 is closed, B+ supply voltage is applied via resistors 474, 476 to emitter 478 of first arming transistor 480. Charging capacitor 482 and resistor 484 are connected electrically in shunt across transistor 480 to ground 138. Correspondingly, the voltage applied to emitter 478 will increase from about 0 volts (the voltage at emitter 478 when switch 472 is open) toward B+ supply voltage as capacitor 482 charges. Base 486 has a voltage applied thereto by means of a voltage divider comprising resistors 490, 492 connected between B+ supply terminal 134 and ground 138. Consequently, when the charge on capacitor 482 reaches a sufficient positive level, transistor 480 is rendered conductive. When transistor 480 becomes conductive, a forward bias is applied to base 496 of second latch transistor 498 which is in turn rendered conductive. B+ potential is applied to the collector 500 of transistor 498 through resistors 502, 504 which are connected to unswitch B+ terminal 134a and because transistor 498 is initially non-conductive.

Biasing resistor 506 provides a current leakage path from base 496 of transistor 498 to ground 138. As transistor 498 turns on, the potential at the commonly connected terminal 508 of resistors 502, 504 drops thereby applying a forwardly biasing signal to the base 510 of third latching transistor 512. Emitter 514 of transistor 512 is connected to B+ terminal 134a and the collector thereof is connected to arm-disarm latch circuit output terminal 516. In response to the signal at base 510, transistor 512 is rendered conductive thereby applying B+ potential to output terminal 516. The potential at output terminal 516 further produces a charge on capacitor 518 connected between terminal 516 and ground 138, thereby slowing the latch response and preventing false triggering due to system noise effect and improving circuit output impedance in the "on" state. This latching voltage at terminal 516 is further applied via resistor 524 and diode 526 to emitter 478 of first latch transistor 480 to hold transistor 480 in a conductive state and provide a latching action. Further, should a momentary interruption of the B+ supply occur, the charge on capacitors 482 and 518 delays the action of the latch circuit such that it will not instantaneously turn off and the B+ potential continues to appear at output terminal 516 thereof. This obviates any disruption of operation of the system that might result from momentary interruption of the system power. Again because of the charge on capacitors 518 and 482, transistor 480 remains conductive for a brief period even in the event of a power disruption to thereby insure that the latch circuit remains latched. Diode 526 blocks in the reverse direction during activation and provides current path in forward direction after activation maintaining a higher input impedance.

A voltage divider comprising resistors 530, 532 is connected between output terminal 516 and ground 138. First transistor 534 of a Darlington-connected pair of transistors has its base 536 connected to the commonly connected terminals 538 of resistors 530, 532 and its emitter 546 connected to ground 138 via a resistor 540. Second transistor 542 of the Darlington pair has its base 544 connected to the emitter 546 of transistor 534 and its emitter 548 connected to ground 138. Collectors 550, 552 of transistors 534, 542, respectively, are connected to B+ terminal 134 through light emitting diode 82 and limiting resistor 556. Thus configured, transistors 534, 542 are normally non-conductive and are automatically rendered conductive when the potential at terminal 516 goes to B+ potential. When transistors 534, 542 become conductive, they provide a current path through light emitting diode 82 rendering the latter luminescent to provide an indication that the circuit is armed. In a preferred embodiment of the invention, light emitting diode indicator 82 is located internally of the secured premises.

Further, ground is applied to the cathode of diode 427 through resistance 425 diode 423, and transistor 420 (FIG. 3C). This reduction in the B+ potential disarms the arm-disarm latch circuit by causing diode 427 to conduct and lowering the potential on emitter 478 of transistor 480, and base 496 of transistor 498 causing transistors 480 and 490 to be non-conducting. This raises the potential on base 510 of transistor 512 causing it to be non-conducting, lowering the potential on line 516. As will be explained in more detail below, this permits entry or exit from the secured premises without generating an alarm signal.

When the system of the present invention is provided with a floor mat sensor, that is, a sensor built into a conventional floor mat to provide an alarm signal in response to a person stepping thereon, or an object being present thereon, a floor mat latch circuit shown in dashed box 580 of FIG. 4 may also be provided. Circuit 580 includes first mat latch transistor 582 having its emitter 584 connected to B+ terminal 134 by resistor 586, resistor 588, and mat arming switch 590. Base 592 of transistor 582 is coupled to voltage divider comprising resistors 594, 596. Resistor 594 is connected to B+ terminal 134a. Resistor 596 is connected to anode of isolating diode 597. Cathode of diode 597 is connected to collectors 550, 552 of Darlington transistor pair 534, 542, respectively, and to cathode of light emitting diode 82. It is seen, therefore, that the arm lamp driver circuit 80 shown in FIG. 1 comprises the Darlington transistor pair 534, 542 and its associated circuitry. Thus configured, transistor 582 will become conductive upon closure of mat arming switch 590 only if transistors 534, 542 are conductive thus biasing diode 597 into conduction connecting resistor 596 to ground 138 through transistor 542. This lowers voltage at base 592 of transistor 582 permitting it to conduct upon closure of switch 590. In other words, the mat circuit will not become armed unless the perimeter circuit is already armed.

Second mat latch transistor 598 has its base 600 connected to the collector 602 of transistor 582 and its emitter 604 connected to ground 138. Base 600 is further connected to ground through leakage biasing resistor 606. Collector 608 of transistor 598 is connected to base 610 of third mat latch transistor 612 through resistor 614. Base 610 thereof is connected to B+ 134a through leakage biasing resistor 616. Charging capacitor 618 is connected between ground 138 and collector 620 of transistor 612. Charging capacitor 622 is connected from emitter 584 of transistor 582 to ground 138. Resistor 624 is connected in shunt with capacitor 622 and resistor 626 and diode 628 are connected between collector 620 and emitter 584 of transistors 612, 582, respectively. Capacitors 618, 622 delay response of circuit 580 such that it will not respond to spurious signals, noise and the like to produce false alarm signals. Floor mat sensor switch 630 has terminal 631 connected to B+ 134 through transistor 612 and has its opposite terminal 632 connected to the intrusion latch circuit 66. This will be explained in detail below. Floor mat latch circuit 580 provides energization for floor mat sensor device 630 when the system has been armed as by closing switch 472 and when mat arming switch 590 has been closed. Light emitting diode 709 provides an indication when mat 630 is energized.

A feature of this invention is that, once the system has been armed by pressing arm button 472, the only way in which it can become disarmed is by operation of the lock circuit 3 pushbuttons in proper sequence, thereby preventing a manual capability of quickly silencing the alarm after a security breach.

Figure 5:
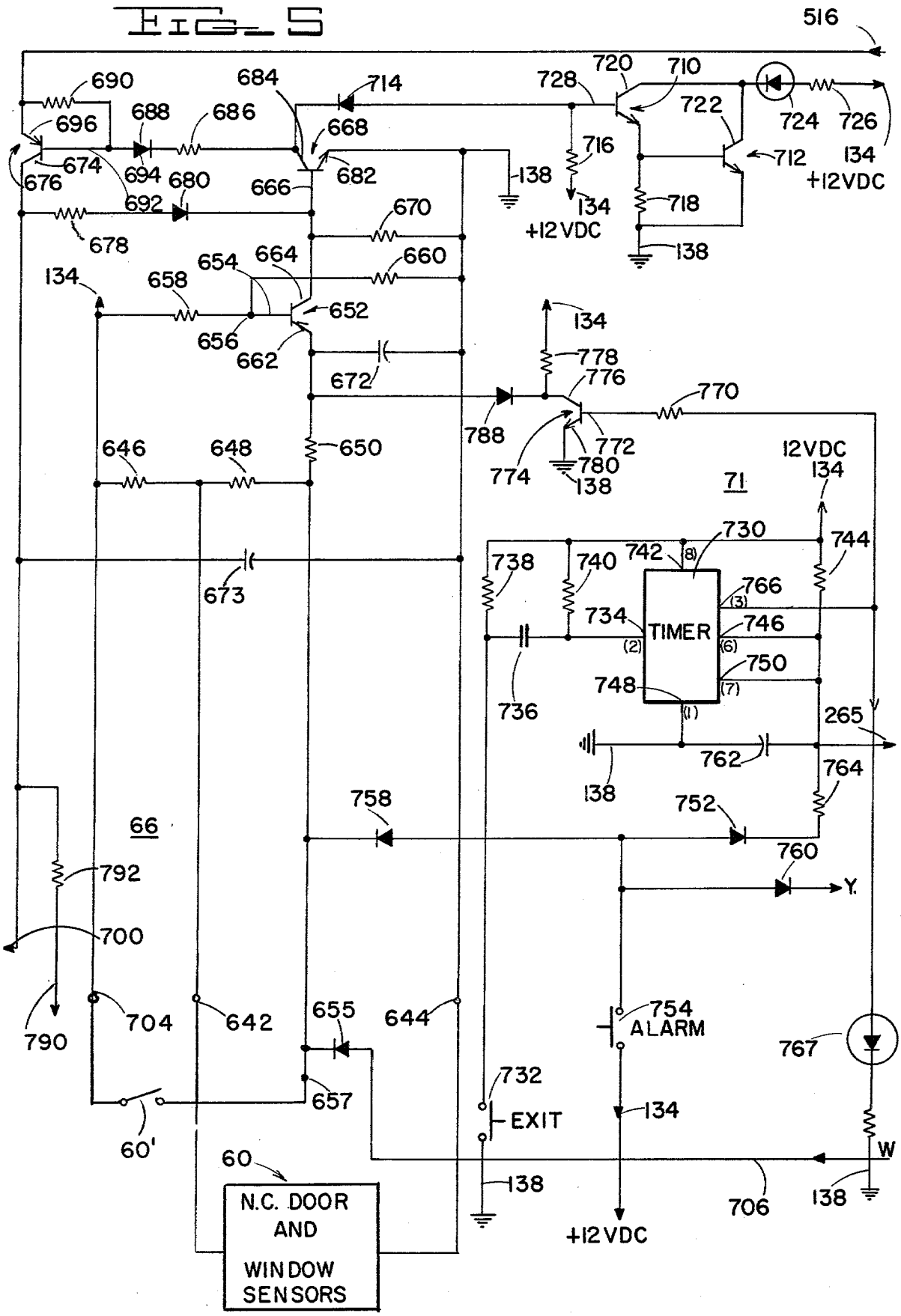
FIG. 5 is an electrical schematic diagram of the intrusion latching circuit.

Referring now to FIG. 5, intrusion latch circuit 66 and exit timer circuit 71 are shown in detail. When the system has been armed by operation of arming-disarming latch circuit 70, (FIGS. 1A and 4), approximately 12 volt DC B+ supply potential is applied to input terminal 516 thereof. A plurality of intrusion sensor switches 60 are connected between sensor terminals 642, 644. Sensor switches 60 are normally closed switches and may, for example, comprise a pair of electrical contacts secured to a window, one of the contacts being secured to the sill and the other to the movable portion of the window whereby opening of the window breaks the contacts. All of the sensors 60 are connected electrically in series whereby opening of a single one of the switches will render the electrical circuit therethrough open.

Terminal 644 is connected directly to ground 138. Terminal 642 is connected to B+ source 134 through resistor 646. Resistor 646 forms one part of a voltage divider network which also includes resistors 648 and 650. First intrusion latch transistor 652 has its base 654 connected to voltage tap terminal 656 of a voltage divider including resistors 658, 660 which are in turn connected between B+ source 134 and ground 138. Emitter 662 of transistor 652 is connected to that terminal of resistor 650 opposite the latter's connection to resistor 648 and diodes 655, 758. Collector 664 is connected to the base 666 of second intrusion latch transistor 668 and to ground 138 through resistor 670. Charging capacitor 672 is connected between emitter 662 and ground 138.

Voltage divider formed by resistors 658 and 660 provides a bias on the base 654 of transistor 652 that is approximately one-half of B+ supply voltage. Hence, the voltage on emitter 662 must be greater than one-half B+ supply voltage before transistor 652 conducts, thus insuring a high degree of noise immunity.

Base 666 of transistor 668 is further coupled to the collector 674 of third intrusion latch transistor 676 through a resistor 678 and diode 680. Emitter 682 of transistor 668 is connected to ground 138 and collector 684 is connected to input terminal 516 through resistor 686, diode 688 and resistor 690. Base 692 of transistor 676 is connected to anode 694 of diode 688 and the emitter 696 is connected to the input terminal 516. This last-described circuitry comprises the basic latching portion of circuit 66. When the circuit is normal, this occurring when all of the switches 60 are closed, first intrusion latch transistor 652 is biased to a non-conductive state by reason of the potential at emitter 662 thereof being below the potential applied to base 654. Similarly, under these conditions, second intrusion latch transistor 668 is biased non-conductive which in turn biases transistor 676 to a non-conductive state. Under these conditions, no B+ potential appears at the output terminal 700 of circuit 66.

If one of the switches 60 is now opened, the circuit path from B+ source 134 through resistor 646 to ground 138 is broken. This causes the potential on the emitter 662 of first latch transistor 652 to rise. This increase in potential is delayed briefly by charging capacitor 672 which must first charge. When the potential on emitter 662 reaches a sufficient positive level, transistor 652 becomes forwardly biased and begins to conduct. This in turn causes the potential on base 666 of second intrusion latch transistor 668 to go more positive and transistor 668 begins to conduct. This event provides a current path from the base 692 of third intrusion latch transistor 676 through transistor 668 and the third intrusion latch transistor 676 also begins to conduct. As transistor 676 becomes conductive, the potential applied to base 666 of second latch transistor 668 through resistor 678 and diode 680 increases thereby driving transistor 668 further into a conductive state. This feedback action continues until transistors 668 and 676 are rendered fully conductive and full B+ potential is now applied to output terminal 700 of the circuit 66. It will again be observed that charging capacitors 672, 673 provide a brief time delay in the operation of the circuit to insure that the circuit will not be triggered by spurious noise signals and the like. Diode 680 acts as a blocking device limiting unnecessary current flow from collector 664 of transistor 652 during latching initialization.

In the event that normally open intrusion sensing devices 60' are used in place of the normally closed switch devices 60, the normally open switches of the elements are connected in parallel between input terminal 704 and input terminal 657 of circuit 66. When the circuit is normal, that is, when all of the normally open switch sensors are open, transistor 676 and circuit 66 are again non-conductive. When one of the normally open switches 60' closes, however, resistors 646, 648 are shunted thereby increasing the positive potential on emitter 662 of transistor 652. Again, this action is delayed for a brief period by charging capacitor 672 to prevent false triggering from noise signals. When the potential at emitter 662 becomes sufficiently positive, transistor 652 again becomes conductive and the operation of the circuit is as above-described. This results in the application of B+ potential at output terminal 700 thereof.

Floor mat intrusion sensor 630 (FIG. 4) is also connected to circuit 66 via input terminal 706. Terminal 631 of floor mat sensor 630 is connected to the output terminal 708 of the floor mat arming circuit. In a normal state, the potential at output terminal 708 is at about B+ potential when the arming-disarming latch circuit 4 has been activated. However, this potential does not pass through the floor mat sensor 630 because of the normally open condition of the switch thereof. However, if an intruder steps onto the mat 630 closing the switch thereof, the B+ potential appearing at terminal 708 is applied to input terminal 706 of the intrusion latch circuit 66. This potential is in turn applied to the common connection of resistors 648, 650 through diode 655 and causes the potential on the emitter 662 of transistor 652 to rise. Again this rise in potential is delayed momentarily by charging capacitor 672. When the potential on emitter 662 reaches a sufficient positive level, transistor 652 is rendered conductive and again latches to an "on" condition to produce a positive B+ potential at output terminal 700 thereof. This operation will be seen to provide a positive alarm signal in response to operation of the floor mat sensor 630.

Darlington connected pair of transistors 710, 712 is coupled to the collector 684 of transistor 668 through diode 714, transistors 710, 712 being biased by means of resistors 716, 718 connected to B+ terminal 134 and ground 138, respectively. The collectors 720, 722 of transistors 710, 712 are connected to B+ terminal 134 through light emitting diode 724 and resistor 726. Transistors 710, 712 are rendered conductive when transistor 668 is non-conductive since base 728 of transistor 710 is then essentially connected directly to B+ terminal 134 through resistor 716. When transistor 668 becomes conductive, base 728 is connected substantially directly to ground through transistor 668 thereby rendering transistors 710, 712 non-conductive. It will thus be seen that light emitting diode 724 provides a visible indication that the system or channel is secure.

To provide a means for permitting exit from the secured premises without disarming the system or otherwise disabling the same, exit timer circuit 71 is provided. Circuit 71 incorporates another "555" timer circuit. An exit button or switch 732 is mounted within the premises adjacent each exit therefrom. Pushbutton 732 has one terminal connected to ground 138 and its other terminal coupled to trigger input 734 of timer 730 through capacitor 736. Resistors 738, 740 are connected from opposite sides of capacitor 736 to B+ supply terminal 742 of timer 730, terminal 742 further being connected to B+ source 134. Resistor 744 is connected from B+ source 134 to threshold input terminal 746 of timer 730.

Discharge terminal 750 is coupled to B+ source 134 through diode 752 and resistor 764 and alarm or "panic" button 754. Button 754 is further coupled to input terminal Y of circuit 66 through another diode 758 and to resistor 474 of the arm-disarm latch circuit 4 (FIG. 4) via a diode 760. Capacitor 762 is connected between ground terminal 748 and discharge terminal 750.

Thus configured, timer 730 functions to generate a positive pulse at its output terminal 766 for a predetermined period of time determined by capacitor 762 and resistor 744. When exit pushbutton 732 is closed, a ground signal is applied through differentiating capacitor 736 to trigger input terminal 734 to initiate operation of the timer. The output at timer output terminal 766 is normally at about zero volts and switches to a positive potential in response to the operation of pushbutton 732. This positive potential at output terminal 766 is applied via resistor 770 to base 772 of transistor 774. Transistor 774 has its collector 776 connected to B+ source 134 through resistor 778 and its emitter 780 is coupled to ground 138. Transistor 774 is non-conductive when the potential at output terminal 766 is at ground and is rendered conductive in response to the positive voltage at terminal 766. When transistor 774 becomes conductive, it provides a direct connection through diode 788 between emitter 662 of transistor 652 and ground 138. This renders transistor 652 inoperative until the timing period of timer 730 expires. In a working embodiment of the invention this timing period is about 1 minute. When timer 730 has timed out, that is, when the potential at terminal 766 thereof goes back to ground potential, transistor 774 is again rendered non-conductive and the intrusion latch circuit 66 returns to its normal operating condition wherein it will respond to the opening of any of the normally closed intrusion sensor switches 60 or normally open intrusion sensor switches 60'. Light emitting diode 767 provides an indication when timer 730 is providing an exit signal.

Switch 754 functions essentially as a panic button. If switch 754 is closed, B+ potential is applied directly to the arm-disarm latching circuit 70 (FIG. 9) to immediately arm the system. B+ potential is simultaneously applied through diode 758 and resistor 650 to emitter 662 of transistor 652 rendering the latter conductive to thereby apply a B+ potential signal to output terminal 700 of the intrusion latch circuit. Operation of switch 754 further applies a steady B+ potential to terminal 265 (FIG. 3C) and through resistor 267 and diode 269 to discharge terminal 264 of timer 244, and diode 752 and resistor 764 to the discharge terminal 750 of timer 730 whereby capacitor 762 will rapidly be charged and return the timers 730, 244 to the non-operating state. This disables timers 730, 244 thus permitting an instant alarm by applying B+ potential through diode 758, thereby triggering intrusion latch 66. After button 754 is released, the intrusion latch remains latched until a disarming signal is generated by proper operation of the digital lock sequence. Circuit 66 may further be provided with an auxiliary output terminal 790 which is connected to output terminal 700 through a resistor 792. Output terminal 790 is adapted to be connected to an automatic telephone dialer such as is commercially available. Appearance of a positive signal at output terminal 790 will cause such an automatic telephone dialer to automatically go into alarm condition.

Referring now to FIG. 6, there is shown the circuitry of the pyrogenic latch circuit 94 (FIG. 1A). The circuit is provided with a plurality of pyrogenic sensors 28 which include a plurality of devices each including a normally open switch, all of the elements 28 being connected electrically in parallel. Load resistor 800 is connected electrically in shunt with elements 28 and one terminal 802 of elements 28 and resistor 800 are connected to B+ terminal 134. The opposite terminals 804 of elements 28 and resistor 800 are connected to sensor input terminal 806. Correspondingly, when all of the pyrogenic sensing elements 28 are in their normally open condition, the potential at input terminal 806 is close to ground potential; a small positive potential will appear at terminal 140 by reason of the current path through resistor 800 which is connected to the base of transistor 144. When there is a circuit discontinuity, an alarm is generated as previously described. This provides a continuous monitoring for circuit defects in the pyrogenic circuit.

First pyrogenic latch transistor 810 has its emitter 812 connected to terminal 806 through resistor 813 and its base 814 is connected to the tap 816 of a voltage divider comprising resistors 818, 820, the latter being connected electrically in series between B+ source 134 and ground 138. Charging capacitor 822 is connected between emitter 812 and ground 138. When pyrogenic elements 28 are in their normal open condition, the potential at emitter 812 is lower than the potential on base 814 of transistor 810. Consequently, transistor 810 is normally non-conductive. Collector 824 of transistor 810 is connected to base 826 of second pyrogenic latch transistor 828. Emitter 830 of transistor 828 is connected to ground 138 and biasing resistor 832 is connected between base 826 and emitter 830. Collector 834 of transistor 828 is connected to B+ source 134 through a voltage divider including resistors 836, 838. Center tap 840 of the voltage divider is connected to base 842 of third pyrogenic latch transistor 844 having its emitter 846 connected to B+ source 134 and its collector 848 connected to ground 138 through resistor 850. Charging capacitor 852 is connected electrically in shunt with resistor 850 and a feedback loop is provided between collector 848 and base 826 of transistor 828 through resistor 854 and diode 856. Fourth pyrogenic latch transistor 860 has its base 862 connected to collector 848 of transistor 844, its collector 864 connected to B+ source 134, and its emitter 866 connected to pyrogenic latch circuit 94 output terminal 96. Biasing resistor 872 is connected between emitter 866 and base 862 of transistor 860 and protective diode 874 is connected electrically in shunt with transistor 860. Completing the pyrogenic latch circuit 94 is pyrogenic circuit test button 880 having its terminals connected between input terminal 806 and B+ source 134.

In operation, all of the sensors 28 are normally open whereby, as described above, transistor 810 is non-conductive and, correspondingly, the potential at collector 824 thereof is at about ground potential. This latter ground potential is applied to base 826 of transistor 828 rendering transistor 828 non-conductive. When transistor 828 is non-conductive, no biasing signal is applied to base 842 of transistor 844 rendering transistor 844 also non-conductive. With transistor 844 non-conductive, the potential at collector 848 thereof is at essentially ground potential, this ground potential being applied to base 862 of transistor 860. This in turn renders transistor 860 non-conductive. Under these conditions, the potential at output terminal 96 of circuit 94 is essentially ground potential.

If one of the switches of one of the pyrogenic sensor elements 28 closes in response to a pyrogenic condition, a circuit path is completed therethrough between B+ source 134 and input terminal 806. This increases the potential at emitter 812 of transistor 810 thereby forward biasing transistor 810 and rendering it conductive. When transistor 810 becomes conductive, the potential at base 826 of transistor 828 increases turning transistor 828 "on". When transistor 828 becomes conductive, the potential on base 842 of transistor 844 decreases rendering transistor 844 conductive. When transistor 844 becomes conductive, the potential on base 862 of transistor 860 rises to about B+ potential rendering transistor 860 conductive. This applies substantially B+ potential to output terminal 96 of circuit 94. Because of the feedback loop through resistor 854 and diode 856, the conductivity of transistor 844 further drives the potential of base 826 of transistor 828 positive thereby insuring that transistor 828 is fully turned on. This condition continues even though pyrogenic sensor 28 is opened and can be reset only by manual activation of the test/reset switch 14-38.

When it is desired to test the operation of the pyrogenic latch circuit 94, test button 880 is depressed. This applies positive B+ potential to emitter 812 of transistor 810 through resistor 813. This renders transistor 810 conductive and, as explained above, causes transistor 860 to become conductive and B+ potential appears at output terminal 96 of the circuit. When pushbutton 880 is released, transistors 828, 844 and 860 will remain conductive and the alarm signal will continue until reset button 14, 38, (FIG. 2) is actuated. Circuit 94 may also be provided with an auxiliary output terminal 882 coupled to output terminal 96 by resistor 870 which can be connected to a commercially available automatic telephone dialing system whereby, when the pyrogenic latch circuit 94 is activated in response to a pyrogenic condition, the dialer will automatically go into alarm condition. Resistor 870 limits output to a safe level under an inadvertent short circuit condition.

Figure 7A:
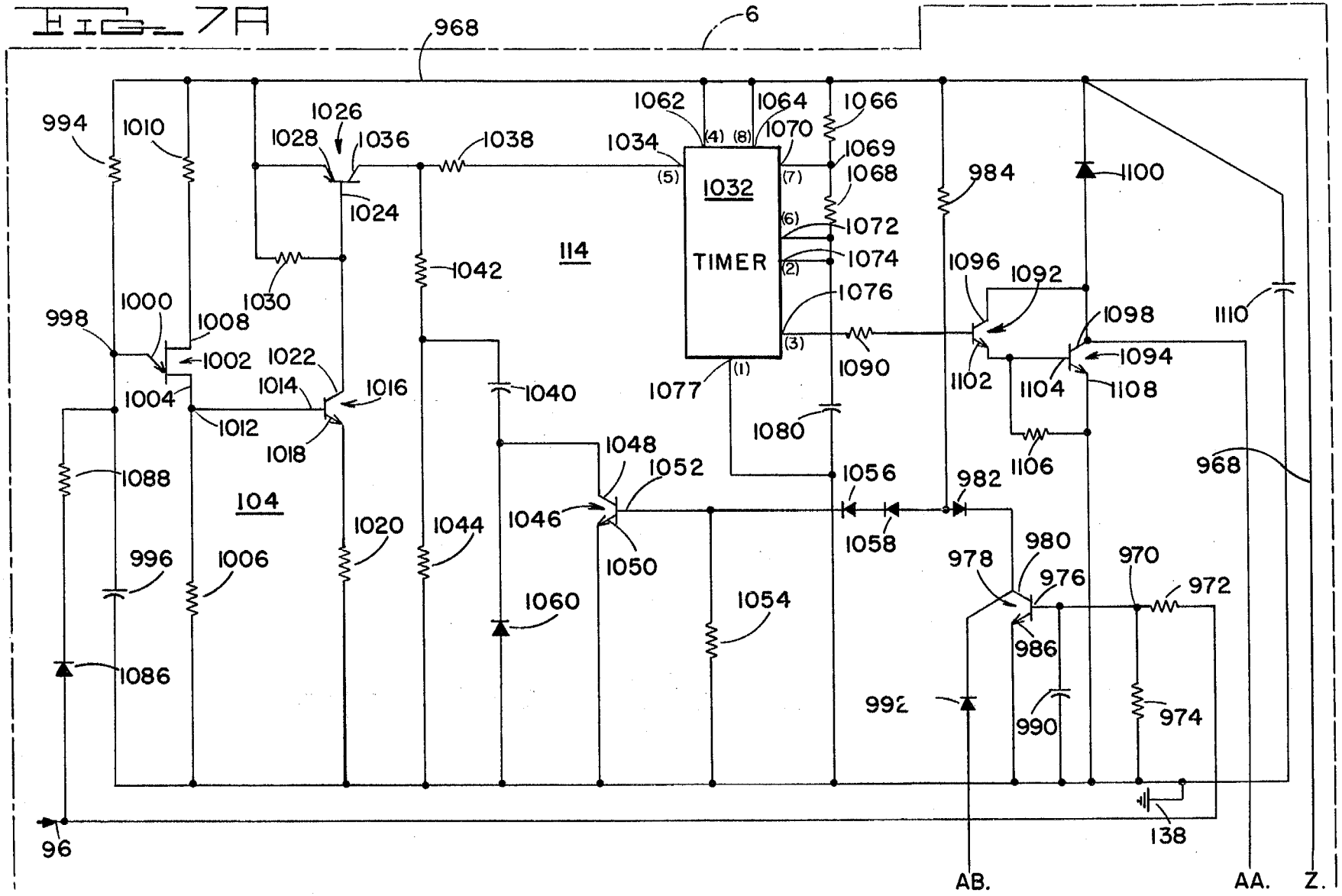
FIGS. 7A and 7B show an electrical schematic diagram of the multitone generator and audible signal generating means of the present invention.
Figure 7B:
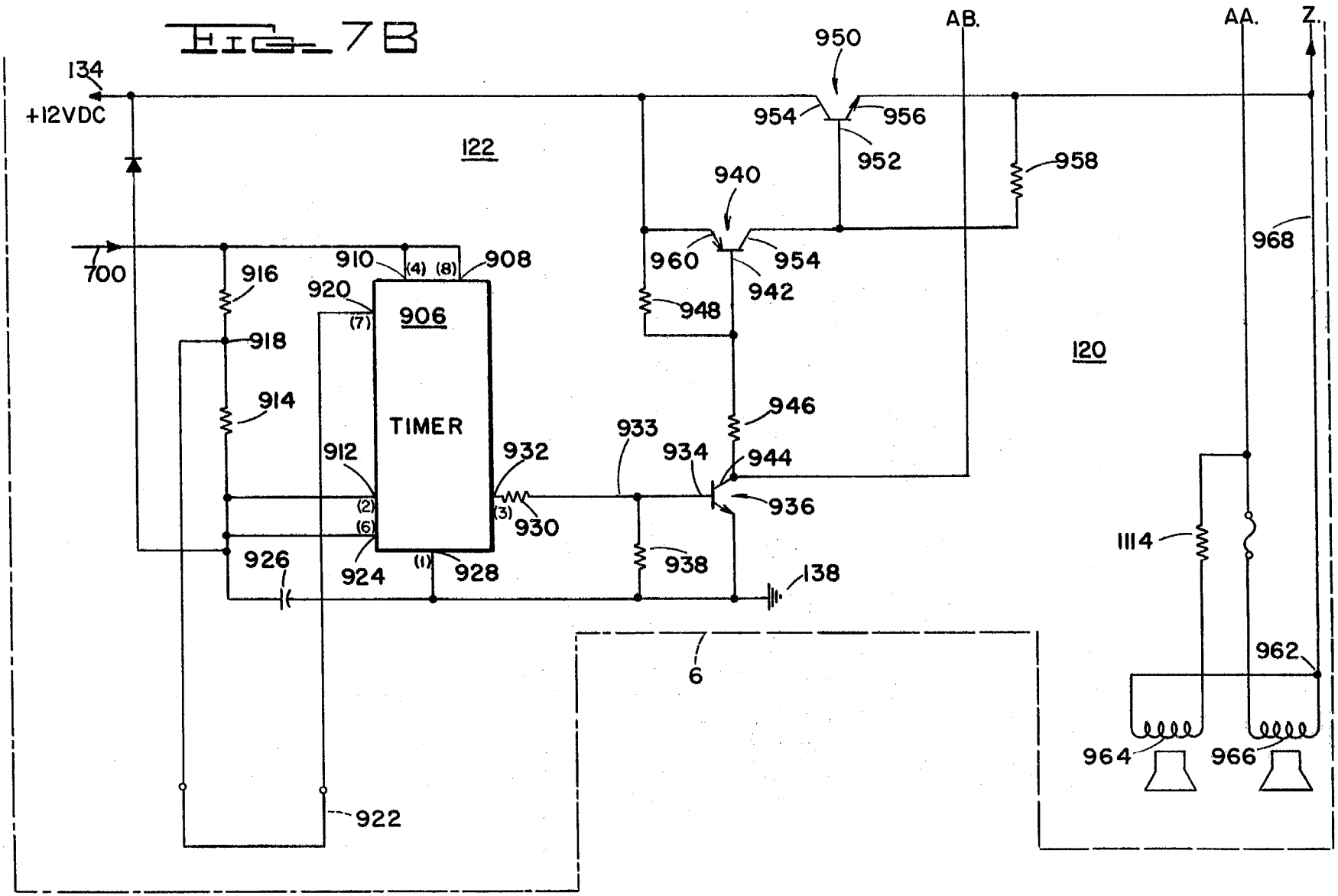

Referring now to FIGS. 7A and 7B, there is shown the circuitry of the tone generator and audible signal generating circuit 6 (FIG. 1A). The circuit includes modulating circuit 104 having first input terminal 968 that is coupled through to the audible signal generating means 120 from output terminal 700 of the intrusion latch circuit 66 (FIG. 5), and a second input terminal coupled to the pyrogenic latch circuit 94 output terminal 96 (FIG. 6). In response to an intrusion into the secured premises, a signal will, as described above, appear at output terminal 700 of circuit 66 (FIG. 5). This signal will be identified as an intrusion alert signal. This intrusion alert signal is a positive B+, direct current signal and is applied to input terminal 700 of the audible signal generating circuit means 6. Another "555" timer circuit 906 is provided having its B+ terminal 908 and reset terminal 910 connected directly to terminal 700. Trigger input terminal 912 of timer 906 is connected to input terminal 700 through a voltage divider comprising resistors 914, 916, the latter having tap terminal 918 that is connected to discharge terminal 920 of timer 906 through a removable jumper wire 922. Threshold terminal 924 of timer 906 is connected to trigger terminal 912 and capacitor 926 is connected between the common connection between terminals 912 and 924 and ground terminal 928 of timer 906. Resistor 930 is connected between terminal 932 of timer 906 and input terminal 933 of audible signal generating means 120. Thus configured, timer 906 will generate a square wave output signal at its output terminal 932 which switches from ground potential to a positive B+ potential. With appropriately selected values for capacitor 926 and resistors 914, 916, timer 906 will switch between "on" and "off" conditions at approximately three minute intervals.

This "on-off" signal is applied to the input terminal 933 of audible signal generating means 120. Connected to terminal 933 is base 934 of a transistor 936. Base 934 is also coupled to ground 138 through resistor 938. Transistor 936 is correspondingly rendered conductive when the signal at output terminal 932 of timer 906 is positive and is non-conductive when the signal at output terminal 932 is at ground. Second transistor 940 of circuit 120 has its base 942 coupled to the collector 944 of transistor 936 through resistor 946 and to B+ terminal 134 through resistor 948. Third transistor 950 of circuit 120 has its base 952 connected directly to the collector 954 of transistor 940 and its collector 954 connected to B+ terminal 134. Emitter 956 of transistor 950 is connected to base 952 through resistor 958. Emitter 960 of transistor 940 is connected directly to B+ terminal 134. In operation, when transistor 936 becomes conductive, the B+ potential on base 942 decreases causing transistor 940 to go from a non-conductive to a conductive state. When transistor 940 becomes conductive, B+ potential is applied to base 952 rendering transistor 950 conductive. Transistor 950 is a power transistor thereby providing a strong B+ signal at its emitter 956. This signal is applied to one terminal 962 of a pair of loudspeakers 964, 966. This B+ potential is also applied via a conductor 968 to circuit 6.

In the alternative, if a pyrogenic condition is detected by circuit 5, an output signal appears at output terminal 96 thereof (FIG. 6) and this signal, which will hereinafter be referred to as a pyrogenic alert signal, is applied to input terminal 96 of circuit 6 (FIG. 7A). This signal is also applied from the center tap 970 of a voltage divider comprising resistors 972, 974 to base 976 of transistor 978. Transistor 978 has its collector 980 connected to conductor 968 through diode 982 and resistor 984. Emitter 986 of transistor 978 is connected to ground 138. Charging capacitor 990 is connected between base 976 and ground 138. In operation, in response to a pyrogenic alert signal from terminal 96, a positive signal is applied to base 976 to render transistor 978 conductive. This action is delayed momentarily by capacitor 990 to prevent inadvertent operation due to noise and the like. When transistor 978 is thus rendered conductive, collector 944 of first transistor 936 of circuit 120 is connected to near ground potential 138 through a diode 992 and the collector 980 and emitter 986 of transistor 978. Grounding of base 942 again renders transistor 940 conductive to render transistor 950 conductive and applies a positive near B+ signal to conductor 968. In this instance, however, the timer circuit 906 is inoperative and the B+ signal on conductor 968 is continuous.

Again, assuming that the intrusion channel has been breached and that the pyrogenic channel is not breached, input terminal 96 will be at essentially ground potential. A strong B+ signal will be appearing at conductor 968, this signal being alternately at about B+ potential and ground potential at three minute intervals. This B+ potential is applied to a charging circuit comprising resistor 994 and capacitor 996. The common connection 998 between resistor 994 and capacitor 996 is connected to emitter 1000 of unijunction transistor 1002. Base-1, 1004 of transistor 1002 is connected to ground 138 through resistor 1006 and base-2, 1008 thereof is connected to conductor 968 through resistor 1010. Thus connected, unijunction transistor 1002 operates as a relaxation oscillator and generates a series of truncated pulses. As the charge on capacitor 996 increases positively, the potential at terminal 998 reaches a sufficient value to trigger transistor 1002 to a conductive state. This in turn discharges capacitor 996 and the cycle repeats. With appropriately selected values, the frequency of operation of transistor 1002 is about three cycles per second.

The output from transistor 1002 appears at output terminal 1012 and is applied to base 1014 of transistor 1016. Emitter 1018 of transistor 1016 is connected to ground 138 through a resistor 1020 and collector 1022 is connected directly to base 1024 of transistor 1026. Transistor 1026 has its emitter 1028 connected to conductor 968 and its base 1024 is connected thereto through resistor 1030. Another "555" timer circuit 1032 has its control voltage terminal 1034 connected to collector 1036 of transistor 1026 through resistor 1038. Charging capacitor 1040 is coupled to collector 1036 of transistor 1026 through charging resistor 1042. A discharge path for capacitor 1040 is provided through resistor 1044 to ground 138.

Transistor 1046 has its collector 1048 connected to capacitor 1040 and its emitter 1050 connected to ground 138. Base 1052 of transistor 1046 is connected through resistor 1054 to ground 138 and through a pair of diodes 1056, 1058 to resistor 984 and through diode 982 to collector 980 of transistor 978. Capacitor 1040 is further connected to ground through diode 1060. Diode 1060 prevents collector 1048 of transistor 1046 from being reversed biased and also provides current discharge path for capacitor 1040.

In operation, transistor 1046 is operatively coupled to transistor 978 such that transistor 1046 is conductive when transistor 978 is non-conductive and transistor 1046 is non-conductive when transistor 978 is conductive. Since transistor 978 is rendered conductive only when a breach of the pyrogenic circuit 5 occurs, transistor 978 will be "off" when the intrusion channel 4 is breached and therefore transistor 1046 will be conductive. Transistor 1046 will further be seen to provide a charging path for capacitor 1040 under these conditions by providing a path therefrom to ground 138. Conversely, when a breach of the pyrogenic channel has occurred, transistor 1046 will be rendered non-conductive whereby capacitor 1040 is not connected to ground and charging thereof will not occur.

In response to a breach of the intrusion channel, unijunction transistor 1002 will discharge intermittently at a frequency of about 3 cycles per second. When unijunction transistor 1002 becomes conductive, transistor 1026 becomes conductive applying near B+ potential to resistor 1042 causing a charging current to flow into capacitor 1040. Transistor 1026 then becomes non-conductive allowing capacitor 1040 to discharge exponentially at a much slower rate than the charge cycle. This combination generates a repetitive exponentially decaying voltage at the control terminal 1034 of timer 1032. Timer 1032 further has its reset terminal 1062 and supply terminal 1064 connected to conductor 968 to receive the B+ voltage therefrom. Voltage divider resistors 1066, 1068 are connected between conductor 968 and timer trigger terminal 1072 with midpoint 1069 being connected to timer discharge terminal 1070. Threshold terminal 1074 of timer 1032 is also connected to terminal 1072 and terminal 1076 is the output terminal of the circuit. Capacitor 1080 is connected between terminals 1074 and 1077 and to ground 138 as shown. Thus configured, timer 1032 operates as a free running oscillator or multivibrator. Appropriately selected values in a working embodiment of the invention produce an output frequency of about one thousand cycles per second. This frequency will, however, be dependent upon the voltage applied to the control terminal 1034 of the timer 1032 whereby the actual output frequency of the timer 1032 will vary in direct proportion to the voltage thereon. Correspondingly, in response to a breach of the intrusion channel 4, the output frequency of timer 1032 will vary between about 800 cycles per second and 1200 cycles per second in accordance with the recurring exponentially decaying pulses appearing at the control terminal 1034 thereof. This, as will be explained in more detail below, is used to generate a characteristic "yelp" alarm signal.

In the event of a breach of the pyrogenic circuit 5, charging capacitor 1040 is disabled as described above. Correspondingly, transistor 978 will remain continuously conductive. Simultaneously, the output voltage from output terminal 96 of the pyrogenic circuit 5 is applied to circuit 104. This voltage is applied through diode 1086 and resistor 1088 to the emitter 1000 of unijunction transistor 1002. This in effect places resistor 1088 in parallel with resistor 994 whereby the charging path resistance to capacitor 996 is substantially reduced and the relaxation oscillator which includes unijunction transistor 1002 will oscillate at a higher frequency. Appropriately selected values will cause this frequency to be about ten cycles per second. Because capacitor 1040 is disabled, the exponentially decaying voltage at control voltage terminal 1034 of timer 1032 is not present but is, rather, a short duration pulse, there being one such pulse occurring on each discharge of unijunction transistor 1002. This control voltage causes the output signal of timer 1032 to be a relatively constant frequency signal with an intermittent sharp tone consisting of a high harmonic content signal preceding or superimposed thereon at a frequency of about ten cycles per second thus simulating a bell clapper sound.

These two output signals, i.e., the output signal resulting from a breach of the intrusion channel and the output signal resulting from a breach of the pyrogenic channel are applied from output terminal 1076 through a resistor 1090 to Darlington connected pair of transistor 1092, 1094. The collectors 1096, 1098 of transistors 1092, 1094, respectively are connected to conductor 968 through loudspeaker windings 964, 966 and bypassed by suppression diode 1100. Emitter 1102 is connected to base 1104 and resistor 1106 is connected between emitter 1102 and emitter 1108, the latter being connected to ground 138 as shown. Filter capacitor 1110 is connected between conductor 968 and ground 138 to filter the B+ supply thus provide a steady source of B+ for the circuit.

Transistors 1092, 1094 are conductive when conductor 968 supplies a positive potential and timer 1032 is operating as a free running multivibrator. Under these conditions, timer 1032 supplies a base drive signal at terminal 1076 through resistor 1090 to the base of transistor 1092. It will thus be seen that transistors 1092, 1094 provide a power drive circuit for speakers 964, 966. The signals applied to speakers 964, 966 will be amplified signals otherwise substantially identical to the output signals appearing at output terminal 1076 of timer 1032. Thus, an audible signal will be generated by the speakers 964, 966 that is either the characteristic "yelp" or "bell" tone signal in response to a breach of the intrusion channel or a breach of the pyrogenic channel, respectively.

Limiting resistor 1114 may be provided in series with one of the speakers 964 to limit the amplitude of the signal therethrough in the event that one of the speakers is to be mounted within the premises.

From the above description, it will be seen that the security system of the present invention is a fully integrated system that includes a closed loop intrusion detection circuit and closed loop fire detection circuit. Entry and exit from the dwelling is controlled by either a digital electronic lock circuit or by means of an exit timer circuit that is operated from within the premises. The system includes positive security latching circuits to provide positive alert signals in the event of a breach thereof. A multiple tone audible generator is provided to provide distinct audible signals characteristic of the type of breach of the system. The system includes means for automatically monitoring the condition of the pyrogenic sensors, for operating independently of conventional 110 volt alternating current, includes a self-contained battery system for energizing the system, and a battery charging circuit to ensure that the battery remains charged at all times. The condition of the battery can further be monitored by a simple and convenient battery monitoring circuit. The circuit can use either normally open or normally closed security sensors. The system can further be fitted with a floor mat alarm, the system including a floor mat latch circuit. The electronic lock circuit can be coded by the user and the code can be changed simply and easily. The entire circuit is solid state and extensively incorporates microelectronic circuits. Unnecessary redundancy in the circuitry is eliminated and the circuitry is exceptionally highly reliable and consumes a minimum of power.

An important feature of this invention is the commonality of circuitry used for the pyrogenic alarm signal and the intrusion alarm signal. The same wave shaping circuitry is used for both signals with one signal differing from the other signal only in the shape of the wave, thereby economizing on componentry. This is accomplished since, as described, a pyrogenic signal on line 96 will cause transistor 978 to conduct, disable the three minute on-off cycle from timer 906; disable transistor 1046; cause diode 1086 to conduct changing the charging path and charging rate of capacitor 996.

In a working embodiment of the invention, the following component values were employed:

RESISTORS

Unless otherwise specified, all resistors are ¼ watt 10%. Resistance values are given in ohms.

| Reference numerals | Component values |
|---|---|
| 678 | 10K |
| 161, 414, 476, 540, 718, 852, 866, 930, 938, 958, 1038, 1106, 563a | 1K |
| 202 | 1K ⅛W |
| 972 | 1.5K |
| 136, 392, 614, 686, 764, 838 | 2.2K |
| 648, 650, 808, 813 | 2K 5% |
| 430 | 2.7K |
| 154 | 2.7K 5% |
| 220 | 3.3K |
| 406 | 3.9K |
| 210, 404, 416, 299, 504, 524, 616, 626, 690, 836, 1044, 563 | 4.7K |
| 218 | 5K 2W |
| 390, 948,974, 1030, 1054, 1068 | 6.8K |
| 520, 532, 606, 670, 832 | 8.2K |
| 142, 490, 492, 530, 658, 660, 716, 800, 818, 916, 1008 | 10K |
| 646 | 20K 5% |
| 246, 252, 738, 740 | 22K |
| 994 | 24K 5% |
| 291, 331, 343, 361 | 27K |
| 484, 624 | 33K |
| 778 | 47K |
| 320 | 56K |
| 262 | 680K 10% |
| 145 | 75K |
| 272 | 43 2W 5% |
| 160 | 1 megohm |
| 744 | 1.2 megohm 5% |
| 914 | 4.7 megohm 5% |
| 1006 | 47 |
| 1020 | 470 |
| 200 | 330 ⅛W |
| 216 | 3.3K |
| 208 | 5 2W |
| 166 | 220 ⅛W |
| 168 | 100 |
| 12 | 10 20W |
| 164 | 68 1W |
| 1042 | 47 ⅛W |
| 946, 984 | 330 ⅛W |
| 1114 | 5 5 ¼W |

CAPACITORS

Capacitance values are given in microfarads.

| | |
|---|---|
| 170, 174, 250, 276, 736 | 0.1 |
| 171 | 2 25V |
| 192 | 2800 35V |
| 226 | 100 25VDC |
| 268 | 15 25VDC |
| 278 | 75 10VDC |
| 2394, 518, 618, 673, 1110 | 30 25VDC |
| 622, 672, 812, 926 | 50 25VDC |
| 990, 996 | 15 35VDC |
| 1080 | 0.1 100VDC |
| 297 | 100 15VDC |
| 383 | 15 10V |

DIODES

| | |
|---|---|
| 190 | full wave rectifier |
| 204, 206, 429, 254–256, 301, 284, 380, 628, 688, 700, 752, 788, 856, 874, 982, 1006, 1056, 1058, 1100, 141, 423 | IN 4001 |
| 214, 274 | IN 4733A |
| 177 | IN 5241 |

TRANSISTORS

| | |
|---|---|
| 512, 612, 844, 102, 561 | MPS 3638 |
| 602, 652 | MPS 3702 |
| 144, 148, 388, 498, 534, 598, 710, 828, 1016 | MPS 3704 |
| 1002 | 2N 2646 |
| 197, 420, 542, 712, 936, 980, 1046 | 2N 3567 |

-continued

| Reference numerals | Component values |
|---|---|
| 196, 860, 1092 | TIP 29 |
| 940 | TIP 30 |
| 194 | TIP 31 |
| 198, 950, 1094 | TIP 33 |

While there have been described the principles of this invention in connection with specific apparatus, it is to be clearly understood that this description is made only by way of example and not as a limitation to the scope of the invention.

What is claimed is:

1. An apparatus for generating an alarm when unauthorized entrances into a dwelling are detected comprising:

perimeter intrusion means having sensor means associated with dwelling entrances which sensor means changes state when an unauthorized entrance is made;

alarm means operatively associated with said perimeter intrusion means to generate an alarm when said sensor means changes state;

alarm latching means to latch said alarm means in an operative state when said sensor means changes state;

first arming means operatively associated with said alarm means so that said alarm means is operable only when receiving an arming signal from said first arming means;

first switching means to cause said first arming means to generate an arming signal;

first latch means to latch said first arming means to generate an arming signal;

disarming means for generating a disarm signal being connected to said first latch means to unlatch said first arming means upon generation of a disarm signal;

visual indication means to indicate that said first switching means has caused said first arming means to generate an arming signal;

said first latch means having a first transistor means with its emitter connected to said first switching means for biased conduction upon the closing of said first switching means;

a second transistor means connected to said first transistor means for biased conduction when said first transistor means is conducting;

a third transistor means connected to said second transistor means and said first transistor means for biased conduction when said second transistor means conducts, and for latching said first transistor means into conduction;

fourth transistor means connected in Darlington configuration and connected to said third transistor means for biased conduction when said third transistor means conducts;

said visual indication means being connected to said fourth transistor means and energized by said fourth transistor means when said fourth transistor means goes into conduction.

2. An apparatus for generating an alarm when unauthorized entrances into a dwelling are detected comprising:

perimeter intrusion means having sensor means associated with dwelling entrances which sensor means changes state when an unauthorized entrance is made;

alarm means operatively associated with said perimeter intrusion means to generate an alarm when said sensor means changes state;

alarm latching means to latch said alarm means in an operative state when said sensor means changes state;

first arming means operatively associated with said alarm means so that said alarm means is operable only when receiving an arming signal from said first arming means;

first switching means to cause said first arming means to generate an arming signal;

first latch means to latch said first arming means to generate an arming signal;

disarming means for generating a disarm signal being connected to said first latch means to unlatch said first arming means upon generation of a disarm signal;

intrusion latching means connected to said sensor means to cause a continuous latching signal upon momentary change of state of said sensor means;

monostable switching means having a stable state and an unstable state;

timer means connected to said monostable switching means and actuated when said monostable switching means is in its unstable state to inhibit said intrusion latching means for a predetermined time period;

second monostable switching means connected to said timer means;

a time constant circuit connected between said second monostable switching means and said timer means, for defeating said timer means when said second monostable switch means is in its unstable position for a predetermined time period;

indicator means for indicating that said intrusion latch means is not activated and that sensors are in an unbreached condition;

said first latching means includes a latching transistor means for conduction in response to a latching condition; and having an emitter and collector, and a base;

a pair of transistor means connected in Darlington configuration being connected between said indicator means and said collector to energize said indicator means when said first latch means is unlatched and to de-energize said indicator means when said first latch means is latched.

3. Security apparatus comprising:

pressure sensing means having sensors placed to detect an unauthorized presence for changing state upon a predetermined pressure applied thereto;

monostable switching means having a stable open position;

arming means operatively associated with said switching means to provide an arming signal upon closure of said switching means;

alarm means operatively associated with said pressure sensing means to generate an alarm when said sensor means changes state and said arming means is providing said arming signal;

latch means to maintain said arming signal upon opening of said switching means;

disarming means being connected to said latch means to provide a disarming signal to unlatch said arming means until said switching means has been closed;

said latch means comprising a latching transistor means for latching into conduction when said arming means is providing an arming signal;

diode means being connected between said latching transistor means and said disarming means;

said disarming means comprising means to provide a voltage change upon a disarming signal, said voltage change being applied through said diode means to said latching transistor means to unlatch said transistor means thereby disarming said alarm means.

4. In a solid state security system having fire and intrusion sensors to produce sensor output signals in response to fire alarm conditions and intrusion alarm conditions respectively, arm/disarm circuit means associated with said intrusion sensors to respond to input signals to arm and disarm the intrusion sensors of said solid state security system, and resettable latching circuit means operatively connected to said sensors to respond to said sensor output signals indicative of alarm conditions by developing a digital output signal indicative thereof and maintaining said digital output signal in a latched condition, the combination of a circuit means operatively connected to said latching circuit means to monitor the output signals of said sensors, and circuit means responding to an externally initiated signal by transmitting reset signals to said latching circuit means and transmitting an arm/disarm input signal to said arm/disarm circuit means.

5. In a solid state security system as claimed in claim 4 further including a plurality of switch means, the predetermined sequential actuation of said switch means providing said externally initiated input signal.

* * * * *